US012123217B2

(12) United States Patent
Zangerle

(10) Patent No.: US 12,123,217 B2
(45) Date of Patent: Oct. 22, 2024

(54) PARKING FACILITY FOR MOTOR VEHICLES

(71) Applicant: Woehr Autoparksysteme GmbH, Friolzheim (DE)

(72) Inventor: Andreas Zangerle, Renningen (DE)

(73) Assignee: Woehr Autoparksysteme GmbH, Friolzheim (DE)

( * ) Notice: Subject to any disclaimer, the term of this patent is extended or adjusted under 35 U.S.C. 154(b) by 0 days.

(21) Appl. No.: 17/872,697

(22) Filed: Jul. 25, 2022

(65) Prior Publication Data

US 2023/0015130 A1 Jan. 19, 2023

Related U.S. Application Data

(63) Continuation of application No. PCT/EP2020/080239, filed on Oct. 28, 2020.

(30) Foreign Application Priority Data

Jan. 30, 2020 (DE) ..... 10 2020 102 244.1

(51) Int. Cl.
*E04H 6/22* (2006.01)

(52) U.S. Cl.
CPC ..... *E04H 6/22* (2013.01)

(58) Field of Classification Search
CPC ..... E04H 6/22
(Continued)

(56) References Cited

U.S. PATENT DOCUMENTS 6,328,521 B1 * 12/2001 Givati ..... E04H 6/22 414/241
9,592,740 B2 3/2017 Niizuma
(Continued)

FOREIGN PATENT DOCUMENTS

DE 3810116 A1 10/1989
DE 20209988 U1 2/2003
(Continued)

OTHER PUBLICATIONS

Search Report received in International Application No. PCT/EP2020/080239 dated Feb. 3, 2021, with translation, 6 pages.
(Continued)

*Primary Examiner* — Glenn F Myers
(74) *Attorney, Agent, or Firm* — Christohpher A. Rothe; CM Law

(57) ABSTRACT

A parking facility for motor vehicles includes a parking rack with parking grids arranged side by side and parking levels arranged one above the other. The parking levels include an uppermost parking level, a lowermost parking level and at least one intermediate level. At least one parking level is connected or connectable to an entrance. The parking rack defines parking spaces where parking grids intersect parking levels. The parking rack has at least one empty space in the at least one intermediate level. At least one displacement device is operative for displacing receiving devices for the motor vehicles in a respective parking level. At least one lifting element is arranged at each parking grid and is coupleable to one of the receiving devices for vertically transporting the receiving device within the parking grid. Each receiving device can assume a transport position and at least one pass position.

27 Claims, 13 Drawing Sheets

(58) Field of Classification Search
USPC ..... 414/234
See application file for complete search history.

(56) References Cited

U.S. PATENT DOCUMENTS

| | | | | |
|---|---|---|---|---|
| 2011/0320035 | A1* | 12/2011 | Kharkover | E04H 6/22 700/218 |
| 2013/0096994 | A1 | 4/2013 | Jakob | |
| 2014/0219751 | A1* | 8/2014 | Segal | E04H 6/24 414/800 |
| 2019/0055746 | A1* | 2/2019 | Lin | E04H 6/22 |
| 2019/0301191 | A1 | 10/2019 | Nussbaum | |

FOREIGN PATENT DOCUMENTS

| | | | |
|---|---|---|---|
| DE | 102004024066 | A1 | 12/2005 |
| DE | 102010019888 | A1 | 10/2011 |
| EP | 1762674 | A2 | 3/2007 |
| EP | 2330262 | A2 | 6/2011 |
| EP | 3550095 | A1 | 10/2019 |
| JP | H04366283 | A | 12/1992 |
| JP | 201277495 | A | 4/2012 |
| JP | 2012207448 | A | 10/2012 |
| JP | 2020002569 | A | 1/2020 |
| WO | 2015145067 | A1 | 10/2015 |

OTHER PUBLICATIONS

Written Opinion received in International Application No. PCT/EP2020/080239 dated Feb. 3, 2021, with translation, 14 pages.

* cited by examiner

PARKING FACILITY FOR MOTOR VEHICLES

CROSS-REFERENCE TO RELATED APPLICATIONS

This application is a continuation of international application number PCT/EP2020/080239, filed on Oct. 28, 2020, and claims priority to German application number 10 2020 102 244.1, filed on Jan. 30, 2020. The contents of international application number PCT/EP2020/080239 and German application number 10 2020 102 244.1 are incorporated herein by reference in their entireties and for all purposes.

FIELD

The present disclosure relates to a parking facility for motor vehicles, comprising a parking rack having two or more parking grids arranged, in particular, side by side in a row, and a plurality of parking levels arranged one above the other, wherein the parking levels comprise an uppermost parking level, a lowermost parking level and at least one intermediate level interposed therebetween and wherein at least one parking level is connectable to an entrance, wherein the parking rack defines parking spaces for the motor vehicles at intersections of the parking grids with the parking levels and wherein the parking rack has at least one empty space in the at least one intermediate level, wherein the parking facility further comprises receiving devices for the motor vehicles, which receiving devices are positionable in the parking spaces.

BACKGROUND

Parking facilities are known of the type in which, for reasons of access time and structural configuration, exactly one intermediate level is provided between the uppermost parking level and the lowermost parking level. Arranged at the intermediate level is the entrance for driving up onto receiving devices in the intermediate level. The receiving devices can be displaced horizontally within the intermediate level. Lifting devices are coupled to receiving devices of the uppermost and lowermost parking levels so that motor vehicles can also be stored in the uppermost and lowermost parking levels. By the transverse displacement of the receiving devices in the intermediate level, the position of the empty space, i.e., a parking space where no receiving device is present at that time, can be varied.

DE 10 2004 024 066 A1 describes a parking facility having parking platforms that can be raised and lowered in a vertical direction by way of chains and can be displaced in a horizontal direction by way of drive wheels.

Positional and orientational terms as used herein are to be understood to relate to an intended installation and use of the parking facility. Here, the parking grids extend in a height direction and are preferably oriented vertically. The parking levels are preferably oriented horizontally. By way of example, such position and orientation terminology can comprise "top", "above", "vertical", "horizontal" and the like.

An object underlying the present disclosure to provide an automated parking facility for motor vehicles with which an increased density of parking spaces can be achieved with acceptable access time.

SUMMARY

In an aspect of the disclosure, an automated parking facility for motor vehicles is provided. The parking facility comprises a parking rack having two or more parking grids arranged side by side and a plurality of parking levels arranged one above the other, wherein the parking levels comprise an uppermost parking level, a lowermost parking level and at least one intermediate level interposed therebetween. At least one parking level is connected or connectable to an entrance. The parking rack defines parking spaces for the vehicles at intersections of the parking grids with the parking levels and has at least one empty space in the at least one intermediate level. The parking facility further comprises receiving devices for the motor vehicles, which receiving devices are positionable in the parking spaces, at least one displacement device operative at a respective parking space for displacing the receiving devices in a respective parking level, at least one lifting device having lifting elements, wherein at least one lifting element is arranged at each parking grid, which lifting element is selectively coupleable to one of the receiving devices for the vertical transport thereof within the parking grid, and a control device for controlling the at least one displacement device and the at least one lifting device. The receiving devices in at least the at least one intermediate level are configured to assume, by control of the at least one displacement device by the control device, in the parking grid, a transport position in which they couple to the at least one lifting element for vertical transport, and to assume at least one pass position in which, by way of the at least one displacement device, they are, relative to the transport position, displaced laterally within the parking grid such that the at least one lifting element is vertically movable in the parking grid by way of the at least one lifting device and thereby passes past the respective receiving device.

BRIEF DESCRIPTION OF THE DRAWINGS

The foregoing summary and the following description may be better understood in conjunction with the drawing figures, of which.

DETAILED DESCRIPTION

Figure 1:
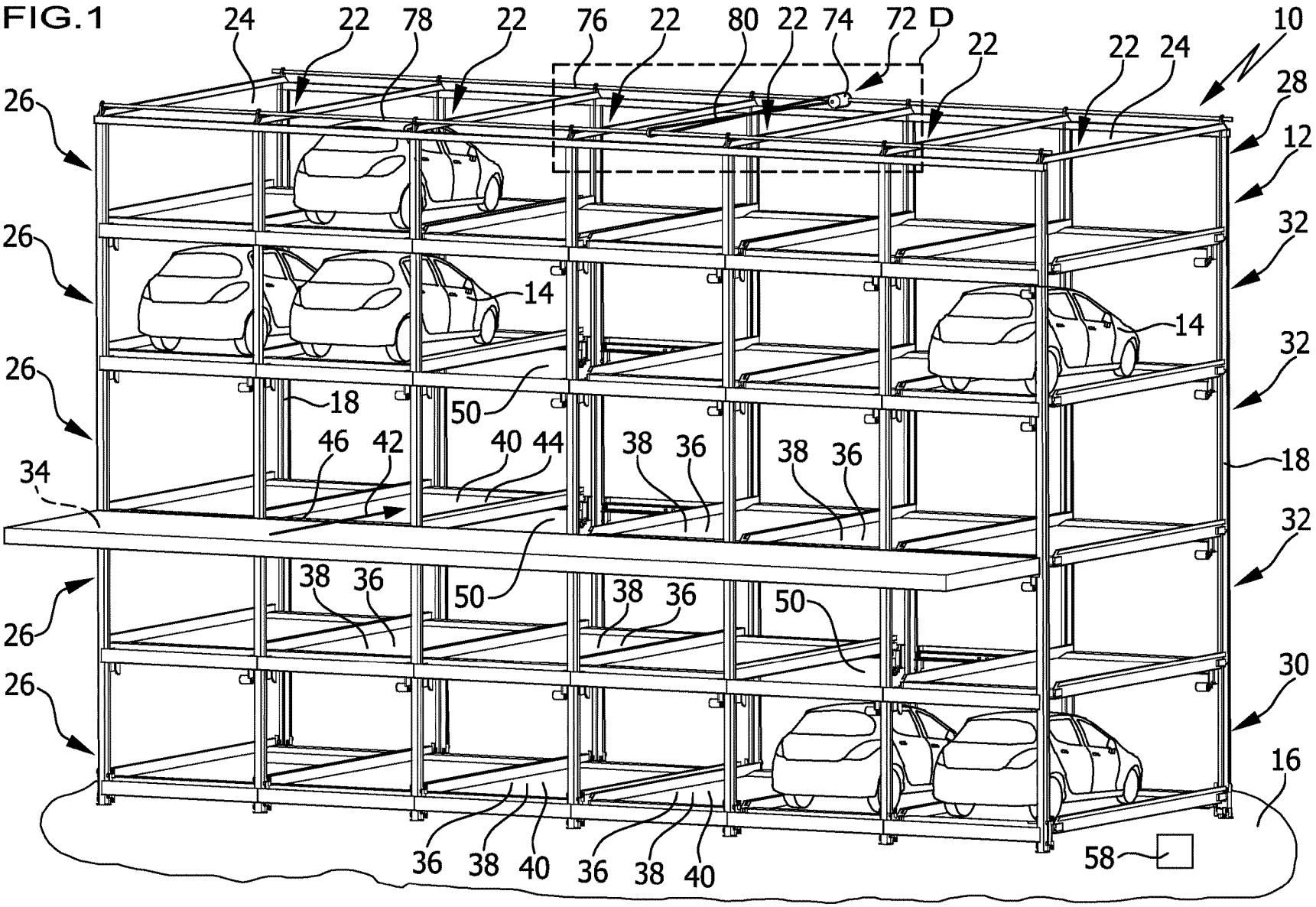
FIG. 1 illustrates a schematic perspective representation of an automated parking facility in accordance with the disclosure.

Although the disclosure is illustrated and described herein with reference to specific embodiments, the disclosure is not intended to be limited to the details shown. Rather, various modifications may be made in the details without departing from the disclosure.

The present disclosure relates to an automated parking facility for motor vehicles is provided which parking facility comprises a parking rack having two or more parking grids arranged side by side and a plurality of parking levels arranged one above the other, wherein the parking levels comprise an uppermost parking level, a lowermost parking level and at least one intermediate level interposed therebetween and wherein at least one parking level is connected or connectable to an entrance, wherein the parking rack defines parking spaces for the vehicles at intersections of the parking grids with the parking levels and wherein the parking rack has at least one empty space in the at least one intermediate level, receiving devices for the motor vehicles, which receiving devices are positionable in the parking spaces, at least one displacement device operative at a respective parking space for displacing the receiving devices in a respective parking level, at least one lifting device having lifting elements, wherein at least one lifting element is arranged at each parking grid, which lifting element is selectively coupleable to one of the receiving devices for the vertical transport thereof within the parking grid, and a control device for controlling the at least one displacement device and the at least one lifting device. The receiving devices in at least the at least one intermediate level are configured to assume, by control of the at least one displacement device by the control device, in the parking grid, a transport position in which they couple to the at least one lifting element for vertical transport, and to assume at least one pass position in which, by way of the at least one displacement device, they are, relative to the transport position, displaced laterally within the parking grid such that the at least one lifting element is vertically movable in the parking grid by way of the at least one lifting device and thereby passes past the respective receiving device.

In the parking facility in accordance with the disclosure, the respective receiving device can assume at least two positions in at least one intermediate level. The positions comprise a transport position and at least one pass position. When in the transport position, the receiving device can couple to the at least one lifting element and can thereby be raised or lowered. When in at least one pass position, the receiving device is, relative to the transport position, displaced within the parking grid such that the at least one lifting element can be moved past, i.e., can pass by, the receiving device. This gives the possibility for the receiving device to be largely or even entirely left within the parking grid. Transverse displacements in the at least one intermediate level can be kept to a minimum in this way. The at least one lifting element, after its passage past the receiving device, can be transported to a receiving device in another parking level and, preferably, be coupled thereto for a vertical transport. This gives the possibility of, for example, keeping access times to the receiving devices relatively short, even when more than three parking levels are arranged one above the other. Preferably, a high density of parking spaces is achieved in the parking rack at the same time.

In particular, the displacement by way of the at least one displacement device is realized in a transverse direction of the parking rack, transversely and in particular perpendicularly to a longitudinal direction of the receiving device.

In the parking spaces, the receiving devices can, for example, be placeable upon support devices which are fixed to the parking rack or are formed by same.

The control of the at least one displacement device and of the at least one lifting device is effected by the control device. Preferably, the control device comprises information about what parking space a particular receiving device is arranged in. Preferably, here, the receiving devices are individualized or identifiable so that the control device has knowledge of what receiving device is positioned at what position within the parking rack in each case.

In particular, vertical transport of receiving devices only occurs from the parking level to which the entrance is connected to a parking level in which the designated parking space for a motor vehicle is arranged, and vice versa.

It is understood that the parking spaces can be associated with individual users or user profiles, wherein relevant links between parking spaces and users or user profiles can be stored in the control device.

The entry level can, in particular, be any of the parking levels. It is preferred, however, that the entry level be an intermediate level.

It is advantageous if, by way of the at least one displacement device, receiving devices are displaceable into at least one adjacent parking grid. In this way, a parking space within a parking grid can be cleared for vertical transport when vehicles are stored and/or retrieved by way of other receiving devices. Provision can be made to allow for the displacement to occur into two parking grids, these being in each case arranged laterally of the parking grid that is to be cleared.

It is advantageous for the receiving devices in the uppermost level and/or in the lowermost level to be configured to assume the transport position and the at least one pass position. This can prove to be advantageous, for example, when the receiving devices of the uppermost and/or the lowermost level are to be lowered or raised by way of the at least one lifting element.

A ratio of a displacement path of the receiving device from the transport position to the at least one pass position—corresponding to a lateral offset of the two positions—to a width of the receiving device is preferably less than 0.5, preferably less than 0.25, more preferably less than 0.2. As an example, the ratio can be about 0.03 to 0.1.

Provision can be made for the receiving devices in the at least one pass position to project in sections thereof into an adjacent parking grid. A compact construction of the parking grid can be achieved in this way.

Advantageously, the receiving devices in end grids arranged at ends of the parking rack are configured to project laterally out of the end grid when in at least one pass position. In particular, the parking grids arranged laterally side by side comprise a first end grid and a second end grid, these being arranged on sides of the parking rack facing away from one another. When in the pass position, the receiving devices can be displaced away from the adjacent parking grid and in particular, here, project out of the end grid.

Preferably, the receiving devices are configured to assume two pass positions in which they are displaced in two directions pointing away from each other, relative to the transport position. The parking facility is thereby rendered highly versatile. The receiving device can be displaced to a first pass position or to a second pass position, wherein the directions of displacement face away from each other, depending on what pass position is advantageous, in particular with regard to a fast access time.

Advantageously, the lateral offset, relative to the transport position, of each pass position is identical.

It can be provided that for each possible direction of displacement within the level, exactly one pass position can be assumed. For a transverse displacement, the respective pass position is thereby defined unambiguously.

Accordingly, in the above-mentioned embodiment, exactly two pass positions can be provided.

In particular, it can be provided that in the transport position, an axis defined by the receiving device aligns with an axis defined by the respective parking grid. In contrast, said axes are spaced apart from one another when in the at least one pass position.

It is advantageous for the control device to be configured to displace the receiving devices such that they assume the at least one pass position in at least one base position. In particular, the base position can be assumed when no storage or retrieval procedure is in progress. Upon such a procedure being initiated, the at least one lifting element can be moved in time-saving fashion past the receiving devices, thereby allowing access times to be kept short.

Here, it is advantageous for the receiving devices within a respective grid to be positioned one above another and displaced in a pass position. In particular, provision can be made for the receiving devices to be only displaced into their transport positions when a motor vehicle is to be stored or retrieved by way of the respective receiving device.

It can be advantageous for the control device to be configured to displace the receiving devices such that, in the absence of actuation of the at least one lifting device and the at least one displacement device (for example when no storage or retrieval process is in progress), at least one parking grid, in the at least one intermediate level, in particular in all intermediate levels, is clear of a receiving device and for the receiving devices of the remaining parking grids to be displaced in a pass position in a direction pointing away from the first-mentioned parking grid. At least one parking grid is thereby cleared in the at least one intermediate level. In the remaining parking grids, the receiving devices assume a pass position if required to enable movement of the at least one lifting element past the receiving devices.

Here, provision can be made for receiving devices in end grids arranged on end sides of the parking rack to be displaced in a pass position in a direction outward from the end grid.

Preferably, the parking rack has more than three parking levels.

The parking rack, in the parking level of the entrance and/or in each intermediate level, preferably has at least one empty space, and has exactly one empty space in particular. This proves to be advantageous for reducing access times. In particular, for clearing a parking grid as previously described, empty spaces can be arranged one above the other by transversely displacing the receiving devices in the parking levels.

It proves advantageous for at least one guide device to be arranged or formed at a respective parking grid for guiding the movement of the at least one lifting element. Preferably, reliable operation of the parking facility is ensured by the guiding of the movement of the lifting element. For example, owing to the guiding, a clearly defined relative position of the receiving device and the parking rack can be ensured during vertical transport.

Preferably, the guide device comprises a first guide element formed by the parking rack, for example by a vertical member of the parking rack, and at least one second guide element arranged at or formed by the at least one lifting element. By utilizing vertical members as guide elements, the structural configuration of the parking facility can be kept simple and a compact construction can be achieved.

In particular, the at least one second guide element can be a guide roller or a sliding guide element at the lifting element.

Preferably, guidance is provided in at least two spatial directions. In particular, here, this can be a longitudinal direction and a transverse direction of the parking rack, corresponding to a longitudinal direction and a transverse direction of the receiving device.

Advantageously, the at least one lifting element engages around the vertical member in a form-locking manner and is movable or displaceable along the vertical member. This affords reliable operation of the lifting device with compact construction.

Preferably, the at least one lifting device comprises at least one traction element and a drive unit, which drive unit is indirectly or directly coupled to the at least one lifting element via the traction element.

Advantageously, the at least one traction element is a chain, a toothed belt or a rope.

As an example, the lifting device can comprise a drivable drive shaft that couples to the chain, toothed belt, or rope. Upon rotation of the drive shaft, the lifting element can be raised or lowered.

In a preferred embodiment, provision can be made for the parking facility to comprise, associated with a respective parking grid, a lifting device, and exactly one lifting device in particular. For example, a plurality of lifting devices can be provided, corresponding to the number of parking grids. Within each parking grid, the receiving devices can be raised and lowered using the respective at least one lifting device. In particular, here, the possibility exists for vertical movements being concurrently performed in different parking grids. The corresponding control can be effected by the control device.

In a preferred embodiment, the parking facility comprises two or more lifting devices, wherein at least one lifting device is associated with the lifting elements of two or more parking grids. Here, provision can be made for the receiving devices of two or more parking grids to be vertically transported by way of only one lifting device. Provision can be made for the lifting device to transport only one receiving device within a parking grid at one time, whereas the receiving devices in the at least one further parking grid assume a pass position for example. Alternatively, provision can be made for simultaneous vertical transport to be carried out in two or more parking grids.

In particular, a parking facility can prove to be advantageous in a preferred embodiment in which the parking facility comprises a lifting device which is associated with lifting elements of all parking grids, in particular wherein one lifting device is provided for the lifting elements of all parking grids. In particular, the lifting device can have only one drive unit for the entire parking rack. The drive unit is, for example, coupled to the lifting elements of the respective parking grids. In particular, depending on whether the receiving devices in a respective parking grid assume a transport position or a pass position, vertical transport can be performed within the parking grid. This includes the possibility to perform vertical transport operations within two or more parking grids or only within one parking grid.

Preferably, the lifting device which is associated with two or more parking grids comprises a drive unit and at least one drive element which being coupled to the at least one lifting element of the respective parking grid. The drive element is, for example, a drive shaft which can be coupled to the traction element mentioned above.

It is advantageous for two or more lifting elements to be arranged at a respective parking grid for vertical transport of the receiving devices of that parking grid. In particular, here, provision can be made for at least one lifting element to be provided in each case at the front and at the rear of the parking rack, relative to a longitudinal direction of the receiving devices. This gives the possibility of raising or lowering the receiving device, in particular at a front side and at a rear side, by way of the lifting elements. The longitudinal direction can, for example, coincide with the direction of entry into a parking grid.

In particular, "front" refers to the side that faces away from the entry side; "rear" refers to the side that faces towards the entry side.

As used herein, the terms "front, front side, rear, rear side/back side" refer in particular to the intended use of the parking facility. Here, for example, a vehicle is driven onto the receiving device in a forward direction. In this case, the front side of the receiving device is in particular arranged at the front of the parking rack and is the side of the receiving device on which the front side of the vehicle is arranged. The rear side of the receiving device is in particular arranged at the rear of the parking rack and is the side on which the rear side of the vehicle is arranged. The front side is the side facing away from the entry to the parking space.

It is advantageous for the at least one lifting device to comprise a synchronizing device which provides mechanical coupling of the at least one lifting element at the front to the at least one lifting element at the rear of the parking grid. By way of the synchronizing device, reliable operation of the lifting device can be ensured in that, for example, canting of the lifting elements can be prevented.

Preferably, the synchronizing device comprises a chain, a belt or a coupling shaft with angular gears; via this or these, drive shafts of the at least one lifting device, each of which is coupled to at least one of the lifting elements, are in operative connection with one another. This affords a passive synchronizing device, preferably whereby the synchronizing device can be limited to a single drive unit.

Preferably, an electronic synchronizing device can be provided, in which, for example, two electric drive units are interconnected control-wise such that the front and rear lifting elements can be moved vertically synchronously, e.g., via the drive shafts.

It is advantageous for four lifting elements to be arranged at a respective parking grid for vertical transport of the receiving devices of that parking grid, wherein two lifting elements are arranged at the front of the parking rack and two lifting elements are arranged at the rear of the parking rack, for coupling in each case to mutually opposite sides of the receiving device. By way of example, the four lifting elements couple to the receiving device at or near corner regions thereof. In particular, relative to the longitudinal direction of the receiving device, which preferably coincides with the motor vehicle direction, two lifting elements are arranged at the front and two lifting elements are arranged at the rear, preferably wherein the lifting elements are positioned in each case on sides opposite each other, in particular left and right front and left and right rear respectively.

In a preferred embodiment of the parking facility, provision can be made for the at least one lifting element, in particular the two or more, in particular four, lifting elements of each parking grid, to be coupleable only to the receiving devices of that parking grid. Accordingly, at least one lifting element is arranged at a respective parking grid, wherein said lifting element can only become operative with receiving devices within the particular parking grid.

In a different preferred embodiment of the parking facility, it is advantageous for at least one lifting element to be arranged at adjacent parking grids in each case, for coupling to the receiving devices of the respective adjacent parking grids when the receiving devices assume the transport position, whereas the lifting element does not couple to the receiving devices when these assume a pass position. This gives the possibility of adjacent parking grids, in a sense, "sharing" a lifting element. When the receiving device of a respective parking grid assumes the transport position, it can couple to the lifting element. In the pass position of the receiving device, the lifting element can be moved past the receiving device. Such an embodiment proves to be advantageous, for example, if the parking grids have a common lifting device associated therewith. Only the receiving device that assumes the transport position is moved vertically. Receiving devices that are not to be moved can be displaced into a pass position beforehand.

In particular, in the latter embodiment, at least one such lifting element can be provided in each case at the front and at the rear of the parking rack, relative to a longitudinal direction of the receiving devices.

Advantageously, two such lifting elements are provided at the front and at the rear in each case, which lifting elements can couple to the respective receiving device at or near the front left, front right, rear left and rear right corner regions thereof.

The at least one lifting element which can couple to the receiving devices of both parking grids is preferably arranged at a vertical member at which the parking grids adjoin one another. Preferably, a guide element is formed by the vertical member.

Preferably, the at least one lifting element comprises or forms at least one support element, preferably wherein the receiving devices each comprise or form a holding element for being supported on the at least one support element when the receiving devices assume the respective transport position. The holding element is, for example, a projection at the receiving device which can be supported on the lifting element. This affords the possibility of configuring the parking facility for simple construction.

As an example, the at least one holding element is non-movably arranged at the receiving device and/or at an end section.

It is advantageous for the at least one lifting element to have two spaced-apart support elements which face towards a respective adjacent parking grid and are configured to couple to the receiving devices of that parking grid when these assume the transport position. This embodiment has proven advantageous in the preferred embodiment that has been described above, in which a lifting element can become operative with receiving devices of adjacent parking grids. Depending on whether the receiving device is to be transported in the left or in the right parking grid, one of the two support elements can be used with the respective holding element of the receiving device.

Preferably, the at least one support element forms a centering region for aligning the at least one holding element and the at least one support element relative to one another. This simplifies the coupling of the receiving device to the lifting element, facilitates the play of moving parts of the parking facility while ensuring reliable operation, and helps compensate for component tolerances.

By way of example, the centering region is or comprises a recess and/or a centering ramp for the holding element.

Preferably, the receiving device can be hooked onto the at least one lifting element at the parking grid in order to couple thereto and can be unhooked in order to be uncoupled therefrom.

Preferably, and in particular in combination with the last-mentioned advantageous embodiment, the receiving device is raisable by moving the lifting element from below against the holding element and raising the latter by way of the at least one lifting element. In this way, a particularly simple construction is achieved with reliable operation. For example, the relative alignment of the lifting element and the holding element can thereby be accomplished very easily.

In particular, it can be advantageous for the respective receiving device to be free of driven active elements to enable coupling to the at least one lifting element. For example, as mentioned above, the holding element is held to the receiving device in a non-movable manner. Having no active elements, the construction of the receiving device can be kept simple, which has an advantageous effect on production costs and operational reliability. In particular, this saves the costs associated with an energy supply for such active elements, in particular also at the receiving device itself, for example via battery or trailing cable.

It proves advantageous for the parking facility to comprise at least one displacement device at a respective parking space for displacing a receiving device arranged at that parking space.

For example, an active displacement device with a drive unit can be arranged in each case at the front and rear of the parking rack for displacing the receiving device.

Alternatively, for example, an (active) displacement device with a drive unit can be provided at only one of the front and rear sides. At the other of front and rear sides, the receiving device can be supported for being carried along passively on, for example, a displacement device or a support device. For example, the receiving device passively travels on rollers or on a displacement track.

It can be advantageous for the at least one displacement device, in particular the plurality of displacement devices, to be configured as a chain conveyor, a belt conveyor or as a roller track. By way of the chain, the belt or the rollers, the receiving device can be displaced within a parking level.

The at least one displacement device can define a contact plane which coincides with a support element of the receiving device. The contact plane is defined for example by the chain, the belt or the rollers. The contact plane can, for example, be oriented parallel to a support plane of the receiving device for the vehicle and/or can be oriented horizontally. In a different embodiment, provision can be made for the contact plane to be inclined relative to a horizontal plane.

It can be advantageous for the contact plane to be oriented relative to a horizontal plane such that it increases starting from a front side or a rear side of the parking rack towards a center of the parking rack. As an example, axes of rotation of the rollers or of drive elements for the chain or the belt can have an orientation that rises starting from the front side or the rear side.

Preferably, arranged at the displacement device and at the receiving device are corresponding guide elements for guiding the displacement movement for the receiving device. For example, provision can be made for a guide track to be arranged at the displacement device, which guide track can have guide rollers of the receiving device in contact thereagainst, or vice versa.

It can be advantageous, for example, for a plurality of guide rollers spaced relative to one another in the direction of displacement to be arranged at the receiving device. In this case in particular, it can be advantageous if, when the receiving device is displaced from one parking grid into an adjacent parking grid, the guide rollers make contact against guide tracks of displacement devices of the adjacent parking grids in order to provide guidance for the displacement into the adjacent parking grid.

It is understood that the receiving device, preferably when displaced from one parking grid to an adjacent parking grid, can at times simultaneously be in contact against displacement devices of the two parking grids, and can in particular be supported on these.

Preferably, in order to hold receiving devices in the respective parking space, at least one support device is provided for supporting the receiving devices when these are arranged at the parking space. It is advantageous for the receiving device to be supported on the at least one support device.

Preferably, at least one support device is arranged at a respective parking space. For example, a support device can be arranged at each of the front and rear of the parking rack.

It is advantageous for the at least one displacement device to form the at least one support device, in particular for a respective displacement device to form a support device. Separate support devices can thereby be avoided.

The support device can be configured such that the receiving device, as has been described above, can be supported thereon and can be passively carried along therewith during displacement. Accordingly, for example, a passive displacement device can also form a support device.

Preferably, the receiving devices can be supported by the at least one support device at the parking spaces thereof irrespective of whether they assume the transport position or the at least one pass position.

It is advantageous for the at least one support device in at least the at least one intermediate level, in particular the plurality of support devices, to be transferrable from a supporting position in which the at least one support device supports the receiving device at the parking space, to a release position, and vice versa, in which release position the parking grid is released for vertical transport of the receiving devices by way of the at least one lifting device, past the support device. To enable transport of a receiving device in the parking grid, for example, the one or more support device(s) positioned thereabove or therebelow can be transferred from the supporting position to the release position. In this way, the cross-section within the parking grid is released such that the vertical transport of the receiving device that is to be moved is enabled.

Preferably, this also applies to the at least one support device, in particular the plurality of support devices, in the uppermost parking level and/or the lowermost parking level.

For example, a receiving device in the uppermost parking level can first be raised off the support device, whereupon the latter is transferred to the release position to enable downward transport of the receiving device.

In the lowermost parking level, for example, provision can be made for the support device to be rigidly and non-movably arranged at the parking rack since the receiving device need only be placed upon the support device and need not be transported downwardly below the latter.

It can prove to be advantageous for the at least one support device to be pivotably supported on the parking rack, in particular on a vertical member or a transverse member, for transfer from the supporting position to the release position, and vice versa.

It can be advantageous for the at least one support device to comprise a drive unit controllable by the control device, for transfer from the supporting position to the release position, and/or vice versa. Alternatively or in addition, provision can be made for the at least one support device to couple to the at least one lifting element and/or the receiving device and to be transferrable by way of these. Accordingly, provision can be made for active transfer of the support device through the use of the drive unit, or for passive transfer thereof in which, for example, corresponding stops at the support device and the lifting element and/or the receiving device cooperate in particular mechanically in order to transfer the support device.

It has already been mentioned that receiving devices can preferably be displaced into at least one adjacent parking grid by way of the at least one displacement device. In this case, it is advantageous for a blocking element to be arranged at the parking grid, by which blocking element the displacement of the receiving device into the parking grid is blockable when the support device arranged at that parking grid assumes a release position, wherein the blocking element is not operative in the supporting position of the support device. In this way, the operational safety of the parking system is enhanced. The blocking element can be a mechanical stop for example.

Provision can be made, for example, for the blocking element to be arranged at the support device of the adjacent parking grid and to be mechanically coupled thereto. By transferring the support device from the supporting position to the release position, the blocking element can preferably be transferred from a non-blocking position to the blocking position, and vice versa.

Preferably, the receiving devices are configured as parking platforms, which can also be referred to as pallets.

Advantageously, the parking facility comprises a sensor device coupled to the control device for determining the position of the respective receiving device within a parking grid, in particular the assumption by the receiving device of the transport position and/or the at least one pass position. The control device can control the at least one displacement device and the at least one lifting device and, if required, also the at least one support device, depending on the signal from the sensor device.

As an example, the sensor device is arranged at the at least one displacement device and/or at the at least one receiving device.

Advantageously, the sensor device can be of the type that is configured or operative to optical and/or inductive and/or mechanical and/or contactless and/or contact-based techniques.

Provision can be made for the parking facility to comprise an electrical charging device which comprises a charging unit at least one receiving device, to which charging unit the motor vehicle positioned on the receiving device can be coupled via at least one electrical connecting line or inductively. This allows the battery of the motor vehicle to be charged while the vehicle resides at the parking space. Electrical energy is supplied, for example, by way of trailing cables or preferably by contact closure when the receiving device is arranged in the parking space. For example, an electrical contact is provided at the at least one support device for this purpose.

Provision can be made for the control device to control the at least one displacement device such that time-delayed displacements between a plurality of receiving devices within a parking level can be performed. In this way, mechanical loads on the parking rack can be kept low.

In particular, it can be advantageous for the parking rack to comprise, in addition to the parking grids arranged laterally side by side, at least one parking grid which is positioned in transverse relation to the arrangement of the parking grids arranged laterally side by side and in adjacent relation to one of these parking grids, and for a crossing by the vehicle to be possible between these parking grids in at least one parking level. As used herein, this can be taken to mean in particular that parking grids can be arranged one behind the other, relative to a motor vehicle's entry direction.

For example, preferably at the entry level at which the entrance is located, a vehicle can be driven across at least one receiving device, through at least one parking grid, and into a parking grid therebehind. Accordingly, parking spaces of the parking rack can be arranged not only two-dimensionally in the horizontal and in the vertical, but three-dimensionally in two horizontal directions and the vertical.

Preferably, the parking rack is implemented as a steel structure.

Preferably, the parking rack can be implemented by only one rack frame. Alternatively, it is conceivable for the parking rack to comprise two or more rack frames, or, in a sense, rack units. For example, parking grids positioned side by side or behind one another comprise separate rack frames. Two or more rack frames can be connected together or detached from one another.

Figure 2:
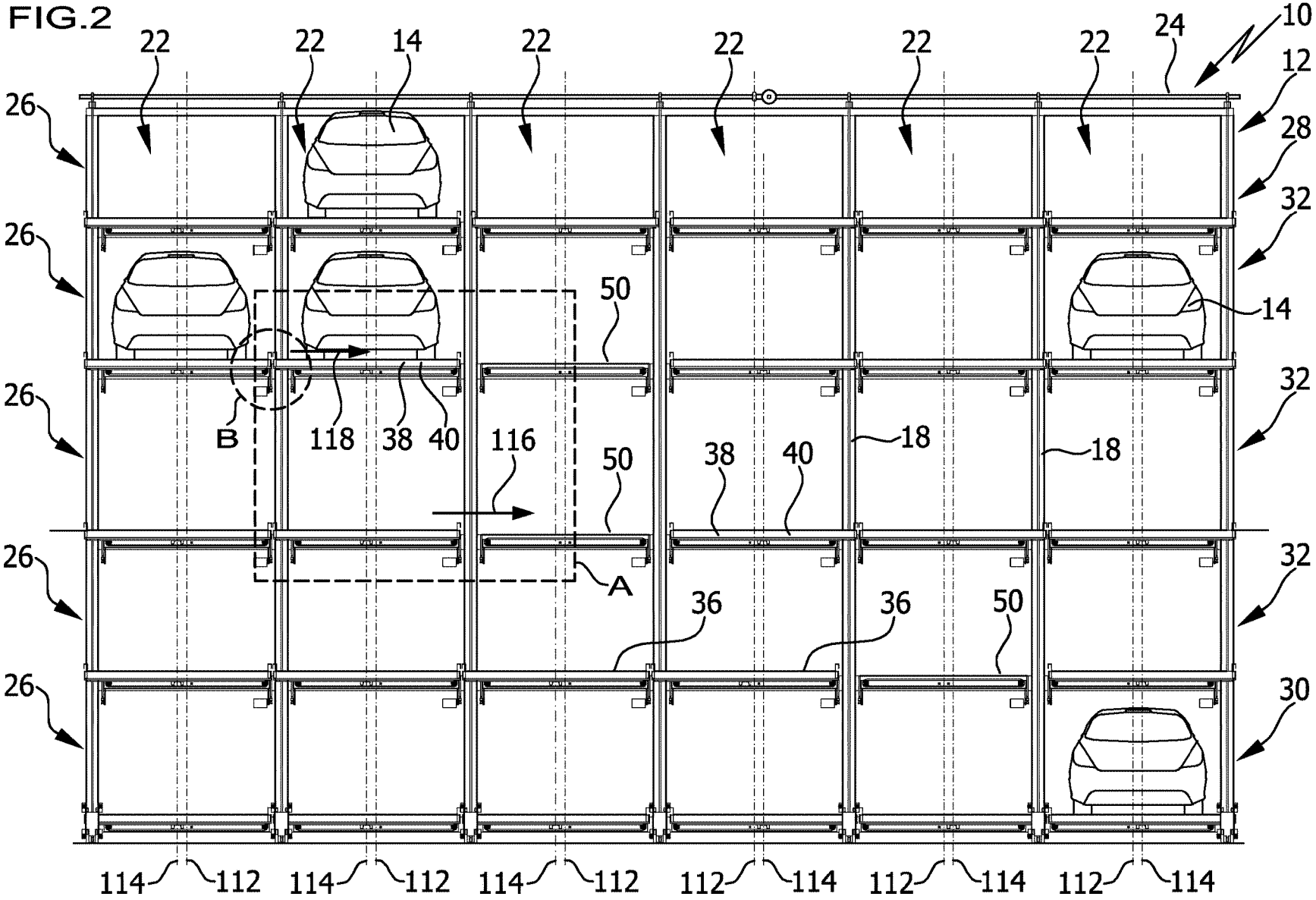
FIG. 2 illustrates a front view of the parking facility of FIG. 1.

FIGS. 1 and 2 show an advantageous embodiment of a parking facility in accordance with the disclosure, generally designated by reference numeral 10. The parking facility 10 comprises a parking rack 12 which is implemented as a steel structure and, in the present case, a rack frame. The parking rack 12 is used for parking motor vehicles 14 (hereinafter "vehicles").

Transactions of storing and retrieving vehicles 14 can be triggered by a user through actuating a user control unit or can be automatically triggered and controlled by the control device of the (in the present case) automated parking facility 10. For storing the vehicle 14, the user preferably drives onto an empty receiving device in the parking grid in which the vehicle is to be stored.

The parking rack 12 is positioned on a supporting surface 16 and comprises interconnected vertical members 18 which extend vertically and comprises transverse members 20 which extend horizontally and connect the vertical members 18 together. Furthermore, longitudinal members can be provided (FIG. 1).

The parking rack 12 comprises a plurality of parking grids 22 which are arranged laterally side by side in a row. End grids 24 are arranged at ends of the parking rack 12, on sides thereof facing away from each other.

In the present case, six parking grids 22 are provided; however, this number could be different.

The parking rack 12 comprises a plurality of parking levels 26. In the present case, five parking levels 26 are provided; however, this number could be different.

The parking levels 26 comprise an uppermost parking level 28, a lowermost parking level 30 and three intermediate levels 32 therebetween.

An entrance 34, which also serves as an exit, is connected to a parking level 26, in the present case this being the middle one of the three intermediate levels 32. The entrance 34 could alternatively be connected to one of the other parking levels 26.

The parking rack 12 defines parking spaces 36 at intersections of the parking grids 22 with the parking levels 26. In the present case, a total of 30 parking spaces 36 exist, although not all of them are used for storing vehicles 14. Receiving devices 38 are provided for storing and transporting a respective vehicle 14, each of which is configured as a parking platform 40 (hereinafter "pallet"), although this configuration could be different.

As used herein, "at the front of the parking rack" refers to the side thereof that faces away from the entry side; "at the rear of the parking rack" refers to the side that faces towards the entry side.

The pallet 40 has a longitudinal direction which can coincide with the longitudinal direction of the vehicle 14. The pallet 40 has a front side 44 and a rear side 46, relative to a customary direction of entry 42 into the parking rack 12. In the present case, the front side 44 and the front side of the vehicle 14 are at the front of the parking rack 12 and the rear side 46 and the rear side of the vehicle 14 are at the rear of the parking rack 12, when in the intended use.

At corner regions at the front left, front right, rear left and rear right, the pallets 40 comprise in each case a holding element 48 configured as a projection, for vertical transport within a parking grid 22. The holding elements 48 will be discussed in more detail below.

In the present case, the number of receiving devices 38 is less than the number of parking spaces 36. Here, provision is made for at least one empty space 50 to exist in each intermediate level 32, which empty space 50 has no receiving device 38 positioned therein at the time under consideration.

However, it is pointed out that because of the possible vertical movements and transverse displacements of the pallets 40, the empty spaces 50 are variable in terms of their position within the parking rack 12. Advantageously, however, the pallets 40 are displaced such that the empty spaces 50 exist in the intermediate levels 32 unless a vehicle 14 is being stored or retrieved.

It is conceivable for the number of empty spaces 50 to be different. At least one empty space 50 is required. In the present case, however, provision of exactly one empty space 50 in each intermediate level 32 affords a relatively high density of parking spaces while at the same time minimizing access times to the pallets 40.

It can be provided that, for reasons of safety, no empty space 50 is provided in the parking level 26 of the entrance 34 when no vehicle 14 is being moved.

As can be seen from FIGS. 3, 8A, 9 and 10 in particular, the parking rack 12 comprises a respective support device 52 at the front and rear of each parking space 36. The pallet 40 can be positioned on and supported by the support device 52 for its positioning in the parking space 36. The front and rear support devices 52 can be of identical construction.

The support device 52 in the present exemplary embodiment of the parking facility is formed by a respective displacement device 54 arranged at a parking space 36. By way of the displacement device 54, a pallet 40 positioned thereon can be displaced horizontally within a parking level 26. The direction of displacement runs in a transverse direction of the parking facility, transversely and in particular perpendicularly to a longitudinal direction of the pallet 40.

The amount of displacement can be freely adjustable, preferably wherein certain extents of displacement can be predetermined, as will be explained below.

A respective drive unit 56 of the displacement device 54 can be activated for displacing the pallets 40. The drive unit 56 is in operative connection with the control device 58 of the parking facility 10 and can be controlled by same.

The pallets 40 can be displaced at each parking space 36 in two directions pointing away from one another within the respective parking level 26. The same applies to the end grids 24.

In the present case, the displacement device 54 is configured as a chain conveyor 60. Alternative configurations are a belt conveyor, a displacement track or a roller track. The chain conveyor 60 comprises a support 62 which is fixed to the transverse member 20 via holding elements 64.

Sprockets 66 are fixed to the support 62. A chain 68 is tensioned around the sprockets 66, which are driven by the drive unit 56. The pallet 40 is supported on the chain 68 and can be displaced horizontally in this way.

Provision can be made for only one side—front or rear—to be driven for the displacement movement, with the other side being passively moved along therewith.

The support 62 is in each case pivotably supported via the holding elements 64 in all of the parking levels 26 except for the lowermost parking level 30. The pivoting motion is about a pivot axis 70. The pivot axis 70 extends horizontally and parallel to the extension of the transverse member 20.

The displacement device 54 is configured to assume a supporting position. In the supporting position, the displacement device 54 projects far enough into the cross-section of the parking grids 22 that the pallet 40, at a respective support element at an end section thereof, can be placed upon the chain 68 (FIG. 9).

Figure 9:
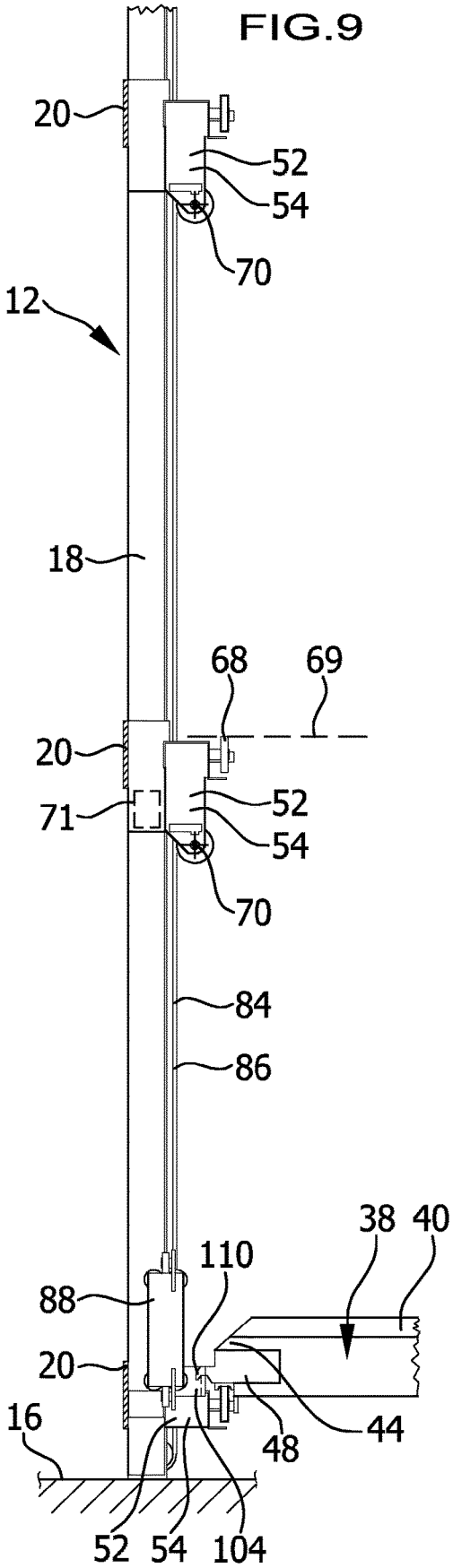
FIG. 9 illustrates a partial representation of the parking facility of FIG. 1, showing support devices as assuming a supporting position.

The displacement devices 54 are configured such that a contact plane 69 is defined by the respective chain 68 (FIG. 9). The contact plane 69 is parallel to a support plane 73 of the pallet 40 for the vehicle 14, and in the present case the contact plane 69 is oriented horizontally. This orientation refers to the assumption of the supporting position by the displacement device 54.

Figure 10:
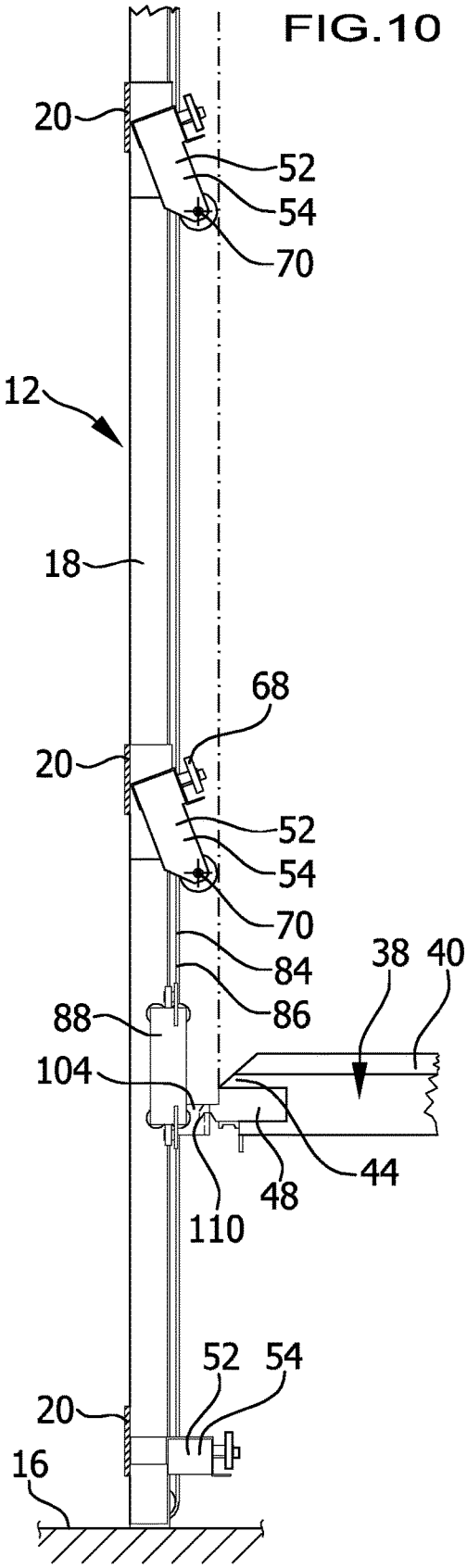
FIG. 10 illustrates a representation corresponding to FIG. 9 after some of the support devices have been transferred to a release position.

The displacement device 54 can be transferred from the supporting position to a release position. For pivoting the displacement device 54 to the release position, the displacement device 54 is pivoted away from the cross section of the parking grid 22 in a direction towards the transverse members 20. The free cross-section within the parking grid 22 is thereby increased (FIG. 10).

When displacement devices 54 assume the release position, the pallets 40 can be transported vertically within the parking grid 22 and can, in particular, be raised and lowered without colliding with the displacement devices 54.

In the lowermost parking level 30, a pivoting of the displacement device 54 is not required since the pallet 40 only has to be placed onto the chain 68 but does not have to be transported past the displacement device 54.

Figure 8:
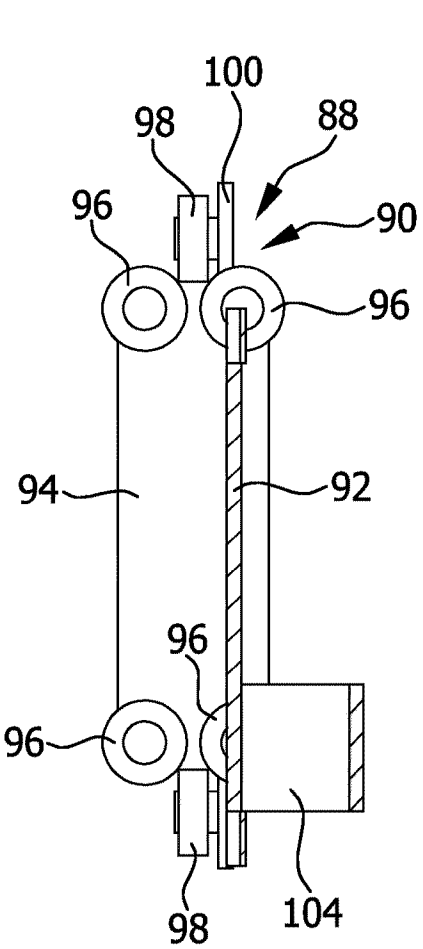
FIG. 8 illustrates a sectional view along line 8-8 of FIG. 7.
Figure 8A:
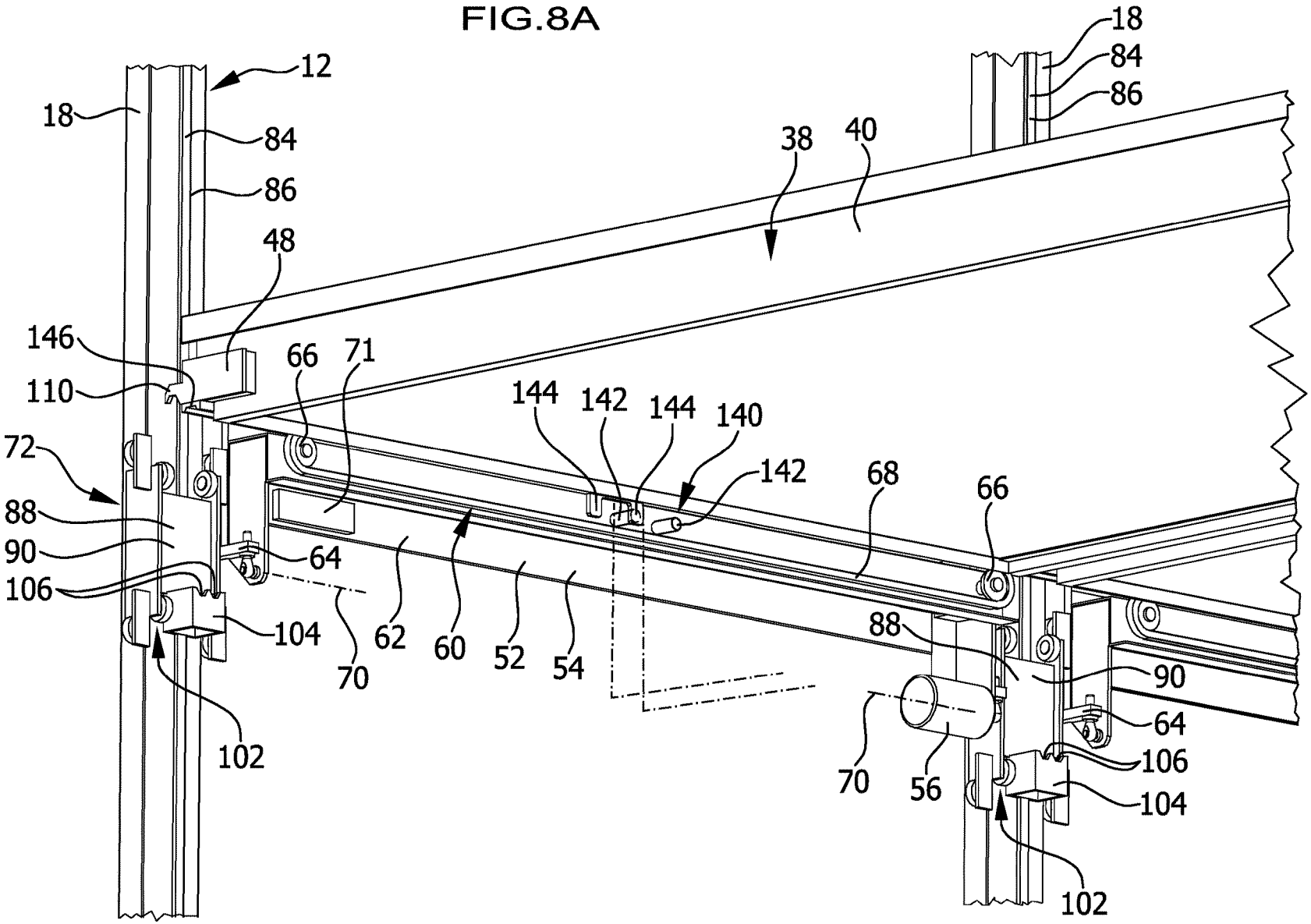
FIG. 8A illustrates a perspective detailed view of the parking facility of FIG. 1, showing a parking platform and a displacement device therefor, viewed from below.

The transfer of the displacement device 54 from the supporting position to the release position, and/or vice versa, can for example occur actively by way of a drive unit 71, shown in FIGS. 8A and 9, in particular under the control of the control device 58. Alternatively, provision can be made for the transfer to occur passively. Here, for example, corresponding stop elements can be provided at the displacement device 54 and at the pallets and/or at the lifting elements described below, which become operative when the pallets 40 are vertically transported.

The parking facility 10 comprises a lifting device 72 for the vertical transport of the pallets 40 within the parking grid 22. In the present case, exactly one lifting device 72 is provided, with which lifting device 72 pallets 40 can be raised or lowered in all of the parking grids 22. Actuation of the lifting device 72 is under the control of the control device 58.

In the present case, provision is made for only one pallet 40 to be vertically transported within a respective parking grid 22. However, it is conceivable, in the context of the present disclosure, that by providing a plurality of lifting elements one above the other within each parking grid 22, a plurality of pallets 40 which are positioned above one another can be vertically conveyed simultaneously.

In a corresponding manner, it is provided in the present case that in the parking facility 10 only one pallet 40 is vertically transported within a parking grid 22, whereas the pallets 40 in the other parking grids 22 remain in place at the parking spaces 36. However, it is reserved to the present disclosure that the pallets 40 can be simultaneously vertically transported in different parking grids 22 within the same parking level 32 and/or in different parking levels 32.

By the provision of only one lifting device 72, a configuration of simple construction can be achieved.

Figure 12:
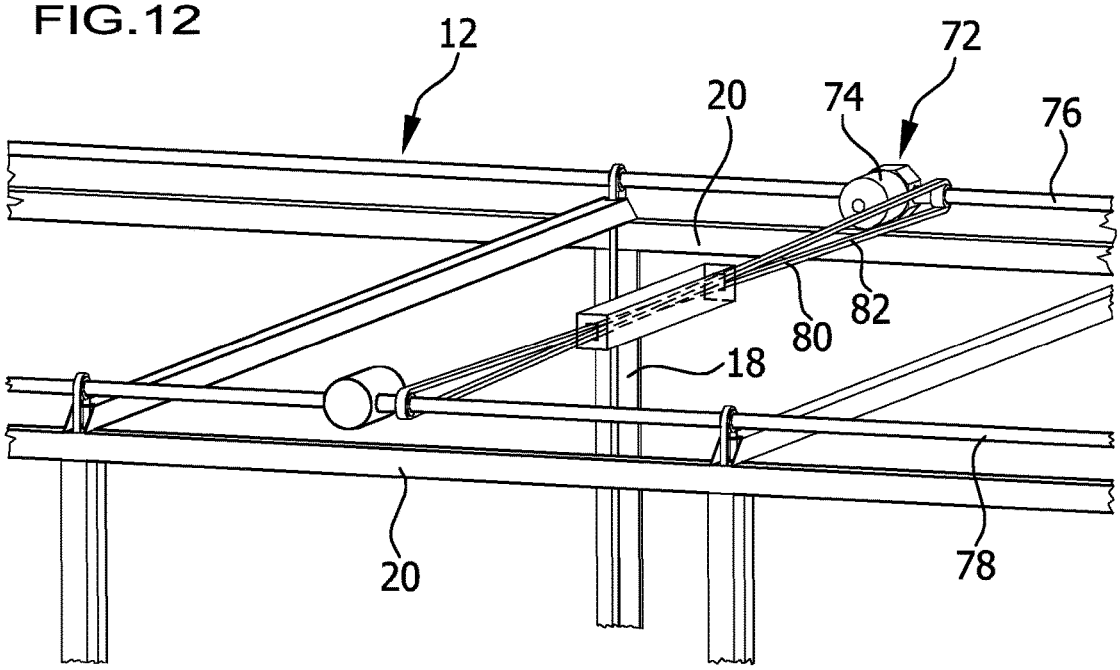
FIG. 12 illustrates an enlarged representation of detail D of FIG. 1.

The lifting device 72 comprises a drive unit 74 (FIGS. 1 and 12). The drive unit 74 is mounted, for example, at the top of the parking rack 12. By way of the drive unit 74, a drive element in the form of a drive shaft 76 can be rotatingly driven. The drive shaft 76 extends horizontally in a transverse direction across the parking grids 22.

In the present case, the drive shaft 76 is arranged at the front of the parking rack 12. A further drive shaft 78 is arranged at the rear of the parking rack 12. The drive shafts 76 and 78 are coupled to one another by way of a synchronizing device 80 of the lifting device 72. The synchronizing device 80 comprises, for example, a chain 82 running crosswise in a guide between the drive shafts 76 and 78. Both drive shafts 76, 78 can thereby be driven in common, but in opposing senses, by way of the drive unit 74.

As an alternative to the chain 82, a coupling shaft with angular gear can be used. Separate drive units for the drive shafts 76 and 78 or an electronic synchronizing device are conceivable.

Fixed to the drive shafts 76 and 78 are in each case a plurality of traction elements 84. In the present case, corresponding to the number of vertical members 18, seven traction elements 84 are provided at the front and seven traction elements 84 are provided at the rear (corresponding to the number of parking grids 22 plus one additional vertical member 18). The traction elements 84 are each configured as a rotating chain 86.

The lifting device 72 comprises lifting elements 88 for lifting, and coupling to, the pallets 40. In the present case, one lifting element 88 is arranged at each vertical member 18, which, illustratively for the parking facility 10, makes seven lifting elements 88 (corresponding to the number of parking grids 22 plus one vertical member 18). This applies to the front and the rear of the parking rack 12 alike.

The lifting device 72 functions in the same way at the front as at the rear; therefore, only the lifting elements 88 that are arranged at the front of the parking rack 12 will be discussed in the following. The same applies analogously to the support devices and the displacement devices 54.

A respective lifting element 88 is fixed to the chain 86 and can thereby be raised or lowered upon rotation of the drive shaft 76.

In the parking facility 10, the lifting elements 88 are each associated with two parking grids 22, with the exception of the lifting elements 88 at the outermost vertical members 18. The possibility exists for each lifting element 88 to transport pallets 40 that are positioned in one of the adjacent parking grids 22.

At the outermost vertical members 18, this is not possible for the reason alone that these laterally bound the end grids 24. However, advantageously, for simplification of production processes, it can be provided for the same lifting elements 88 to be used at the outermost vertical members 18 as are used at the inner vertical members 18, which in each case separate parking grids 22 from one another on both sides thereof.

As can be seen from FIGS. 4 to 8 in particular, the lifting element 88 is configured in the form of a slider 90 which is displaceable along the vertical member 18 and engages around the vertical member 18 in a form-locking manner.

The lifting element 88 comprises a base plate 92 and two lateral plates 94 fixed thereto. Guide elements in the form of guide rollers 96 are fixed to the lateral plates 94. Here, two guide rollers 96 are provided on each lateral plate 94 for contact against the front of the vertical member 18, and two guide rollers 96 are provided for contact against the rear of the vertical member 18.

Further guide rollers 98 are arranged at projections 100 which are held to the plates 94. The guide rollers 98 are in contact against a side of the respective vertical member 18.

A sliding guide can be provided in lieu of roller guides.

The chain 86 is held, by way of example, to the base plate 92.

The vertical member 18 forms a guide element corresponding to the guide rollers 96, 98 so that a guide device 102 is provided for a respective lifting element 88. Via the guide device 102, the lifting element 88 can be reliably displaced along the vertical member 18 without canting.

The lifting element 88 projects from the vertical member 18 into the free cross-section of the respective parking grid 22.

The lifting element 88 comprises a receiving device 104 for receiving at least one pallet 40. The receiving device 104 projects from the base plate 92 into the cross-section of the parking grid 22.

Formed at the receiving device 104 are two receptacles, spaced apart in the transverse direction of the parking rack 12, for the holding elements 48 of the pallet 40. The receptacles are configured as support elements 106 which are open upwardly and have a downwardly tapering centering region 108. The receiving device 104 thereby presents an approximately W-shaped section in plan view.

The support elements 106 are dimensioned such that a respective holding element 48 can be supported thereon. Alignment of the pallet 40 relative to the lifting elements 88 is accomplished via the centering region 108. In this way, the pallets 40 can be hooked onto the lifting elements 88 in a simple and reliable manner. When in the hooked condition, the holding elements 48 engage around the support elements 106 by way of a curved projection 110 (FIGS. 8A and 9).

Figure 4:
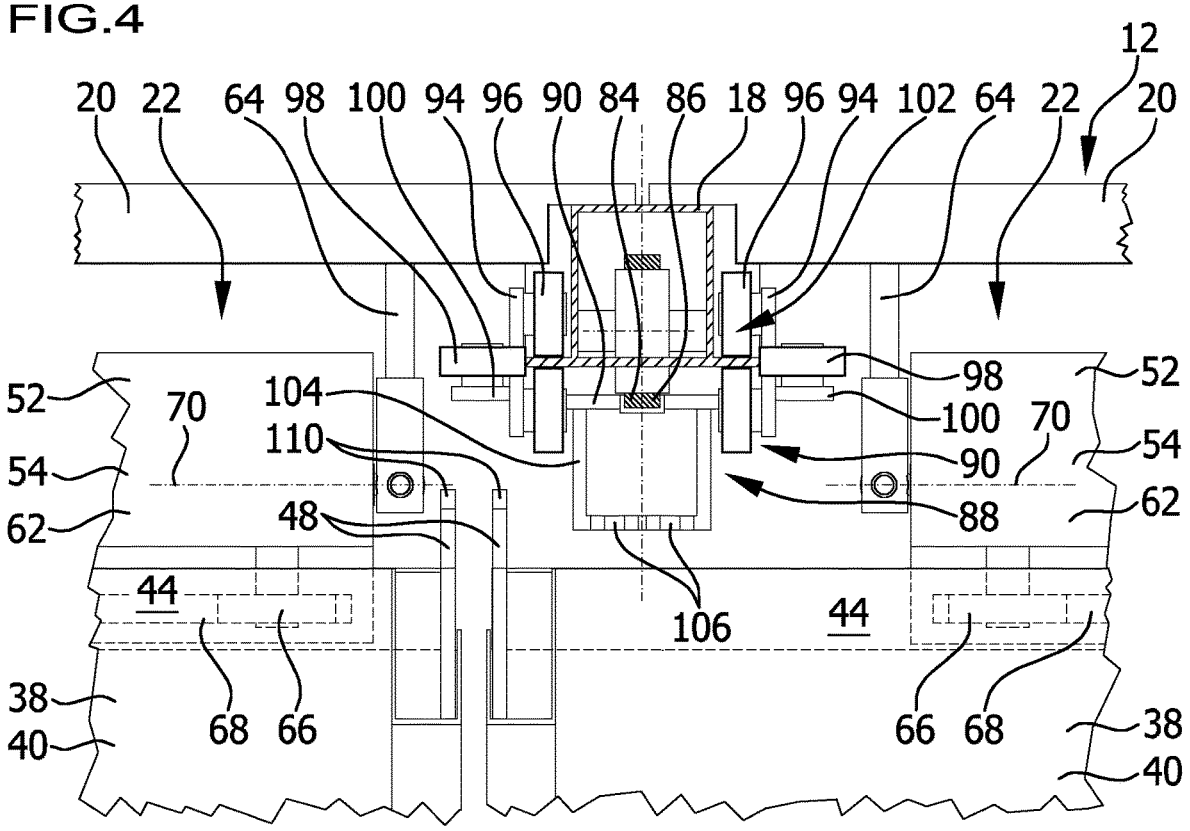
FIG. 4 illustrates an enlarged representation of detail B of FIG. 2 in a top view, partially cut away.
Figure 7:
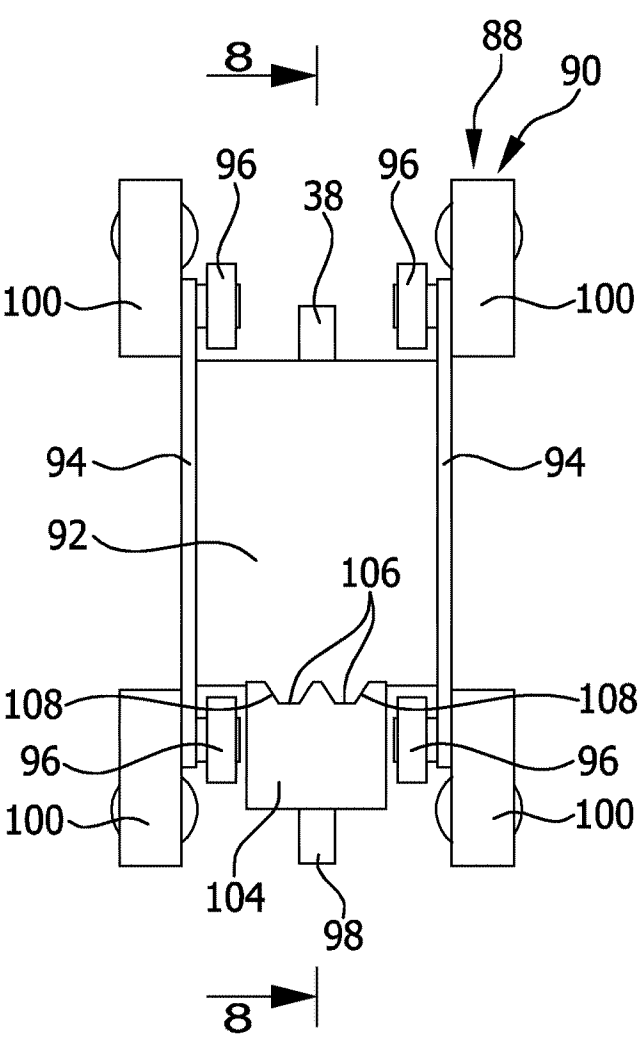
FIG. 7 illustrates a front view of the lifting element of FIG. 6.
Figure 6:
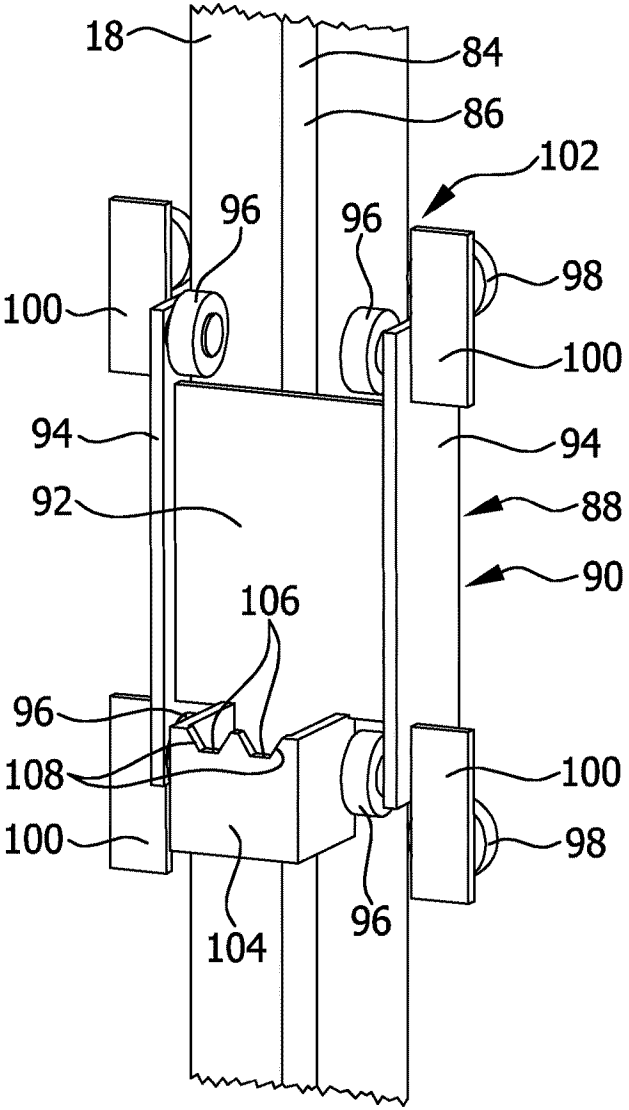
FIG. 6 illustrates an enlarged representation of a lifting element which is displaceable on a vertical member.

For transporting a pallet 40 in a parking grid 22, the pallet 40, at all four holding elements 48, front left, front right, rear left and rear right, is hooked onto lifting elements 88. Here, the one support element 106 that faces towards the pallet 40 is used in each case. The other support element 106 remains free (FIG. 4). This other support element 106 serves the vertical transport of the pallet 40 of the adjacent parking grid 22.

Provision can be made for the lifting element 88 to comprise only one support element 106.

It is advantageous for the pallets 40 to be free of driven active elements, both for the coupling to the lifting elements 88 for the vertical movement and for the transverse displacement by way of the chain conveyors 60. In particular, this saves the costs associated with an energy supply for such active elements at the respective pallet 40.

In the following, the principle of operation of the parking facility 10 will be described with reference to FIGS. 1 to 5 in particular.

The pallets 40 can assume a transport position by displacement by way of the displacement device 54 under the control of the control device 58. In particular, when in a transport position, the pallet 40 is arranged centrally in the parking grid 22 such that an axis 112 of the parking grid 22 is in line with an axis 114 of the pallet 40.

In the transport position, the pallet 40 is oriented relative to the lifting elements 88 of the adjacent vertical members 18 such that the holding elements 48 are capable of coupling to the support elements 106. This gives the possibility of hooking the pallet 40 onto the lifting elements 88 for raising or lowering same. When the pallet 40 assumes the transport position, the lifting elements 88 that are associated with this particular parking grid 22 cannot be moved past the pallet 40.

In order to enable this, namely movement of the lifting elements 88 past the pallets 40 in the parking space 36, each pallet 40 can be transferred to at least one pass position.

The transfer to the pass position is realized by transverse displacement within the parking grid 22 by way of the displacement devices 54.

Figure 5:
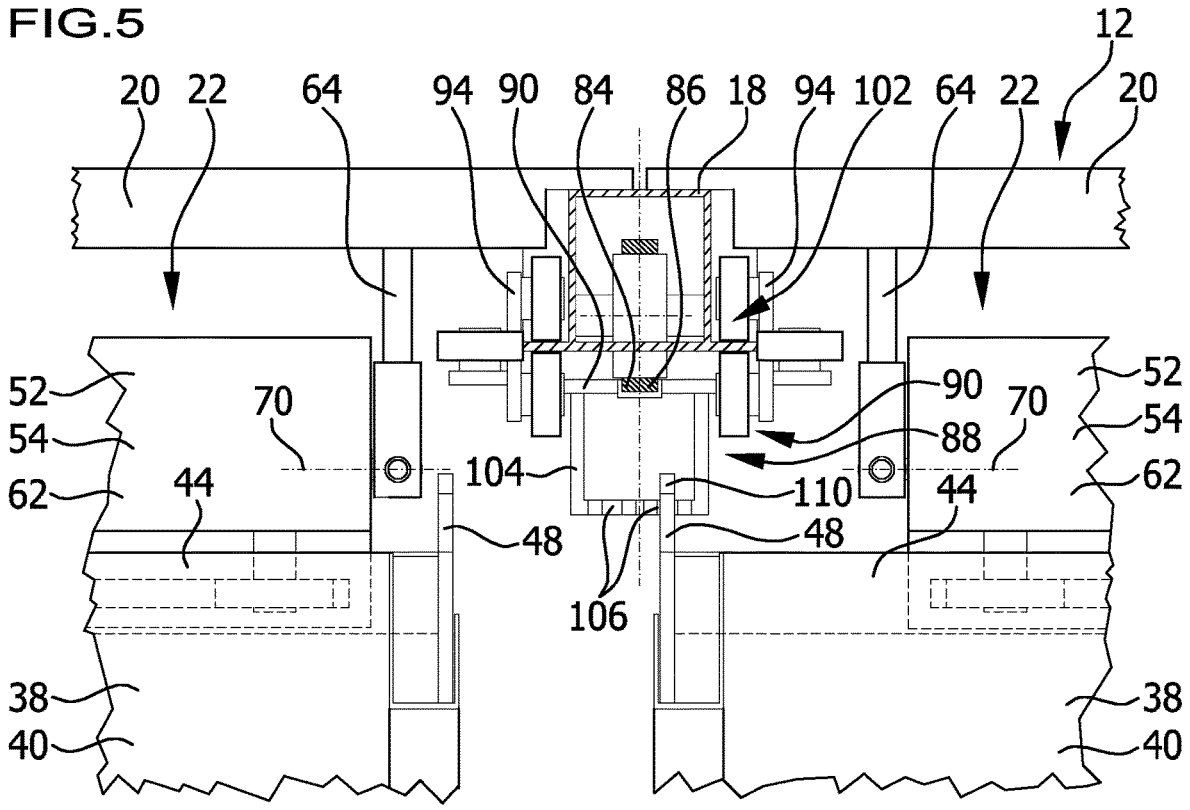
FIG. 5 illustrates an enlarged representation of detail C of FIG. 3 in a top view, partially cut away.

Here, the pallets 40 can be displaced within the parking space 36 to such an extent that the lifting element 88 can be moved past the pallet 40. This is shown illustratively in FIG. 4, wherein the pallet 40 shown on the left in the drawing is displaced to the left, as is the pallet 40 shown on the right in the drawing. The latter has moved to the left in relation to what is shown in FIG. 5.

It is advantageous for each pallet 40 to be able to assume two pass positions. The possibility exists of performing, by way of the displacement device 54, a displacement movement in the direction of the two adjacent parking grids 22 in each case. In the respective pass position, the pallets 40, in sections thereof, project into the adjacent parking grid 22.

The pallets 40 can be displaced in both displacement directions also in the end grids 24. When displaced outwardly, the pallets 40 project out of the end grids 24 in sections thereof.

In the respective pass position, the axes 114 of the pallets 40 and the axes 112 of the parking grids 22 are spaced apart from one another (FIG. 2).

In a practical implementation of the parking facility, the lateral offset between the transport position and a pass position can be, for example, about 5 cm to 30 cm, preferably about 10 cm to 20 cm.

As an example, the ratio between a displacement path of the pallet 40 from the transport position to the at least one pass position—corresponding to the lateral offset—and a width of the pallet 40 is about 0.03 to 0.1.

A width of the pallet 40 can be about 240 cm to 280 cm for example.

The situation described above can be seen, for example, from FIG. 2. In the figure, empty spaces 50 exist, arranged one above the other, in the two upper intermediate levels 32.

The pallets 40 on both sides of the empty spaces 50 are in each case displaced outwardly, in a direction pointing away from the parking grid 22 with the empty spaces 50, and thereby assume a pass position in each case. This has the advantage that it allows the lifting elements 88 to be moved freely within these parking levels 26.

An empty space 50 also exists in the lower intermediate level 32. The pallets 40 lying laterally next thereto are also displaced outwardly away from the empty space 50 and assume a pass position so that, here again, displacement of the lifting elements 88 is possible.

As far as possible, the pallets 40 are positioned in a basic position by the control device 58 when no retrieval or storage operation of a vehicle 14 is in progress. Preferably, the basic position corresponds to a pass position in order to facilitate the movement of the lifting elements 88 and thereby reduce access times.

The pallets 40 of the lowermost parking level 30 also assume a pass position so that the lifting elements 88 can be moved upwards or downwards past the pallets 40 without the pallets 40 first having to be displaced transversely. Then the pallets 40 can be moved to the transport position to the left or right and can be lifted by way of the lifting elements 88.

In the present case, in the uppermost parking level 28, a pallet 40 above the empty spaces 50 assumes the transport position, whereas those arranged laterally next thereto are displaced outwardly into the pass position. In the uppermost parking level 28 as well, it can be provided that the pallets 40 can assume a base position which corresponds to the pass position.

It can be provided that, in the absence of retrieval or storage transactions for vehicles 14, the pallets 40 are displaced such that the empty spaces 50 are arranged one above the other and are located within the same parking grid 22. This parking grid 22 has then be cleared except for the uppermost and lowermost parking levels 28, 30.

The parking facility 10 comprises a sensor device 140 which is coupled to the control device 58. By way of the sensor device 140, it is possible to determine the position of a respective pallet 40 in the parking grid 22 (FIG. 8A), in particular the assumption of the transport position and one of the pass positions.

To this end, the sensor device 140 comprises two sensor elements 142 which in the present case are positioned in spaced relation to one another at the support 62 or, for example, at the transverse member 20. Corresponding projections 144 are arranged at the bottom of the pallet 40.

The sensor elements 142 are, for example, inductive sensor elements which provide a different signal for the presence than for the absence of the respective projection 144.

In the transport position of the pallet 40, each sensor element 142 is in opposition to a projection 144. In the pass position, one sensor element 142 is clear of a projection 144 and the other sensor element 142 is in opposition to a projection 144. The control device 58 is capable of distinguishing between the transport position and the pass positions, depending on which sensor element 142 is delivering a signal.

In the following, a retrieval process will be explained for the vehicle 14 shown in FIGS. 1 to 3 as being positioned in the uppermost intermediate level 32, in the second parking grid 22 from the left. Without restricting the generality, it is assumed that the pallets 40 assume the positions (transport position or pass position) as are shown in FIG. 2.

The pallet 40 in the parking space 36 is supported on the displacement device 54.

In order for the pallet 40 to be capable of being transported to the entrance 34 at the middle intermediate level 32, first the pallet 40 below the vehicle 14 has to be removed. This is realized by way of the displacement devices 54 in the middle intermediate level 32 (arrow 116).

In order for the pallet 40 with the vehicle 14 to be capable of being transported vertically, the drive unit 74 is activated. The lifting elements 88 can all be moved along the vertical members 18 because all of the pallets, at least those below the relevant parking level 26, assume a pass position.

The pallet 40 is displaced from the pass position to the transport position by way of the displacement device 54, i.e., to the right in the drawing (arrow 118).

It is understood that transverse displacements and vertical movements, which cannot interfere with one another, can be performed simultaneously.

Figure 3:
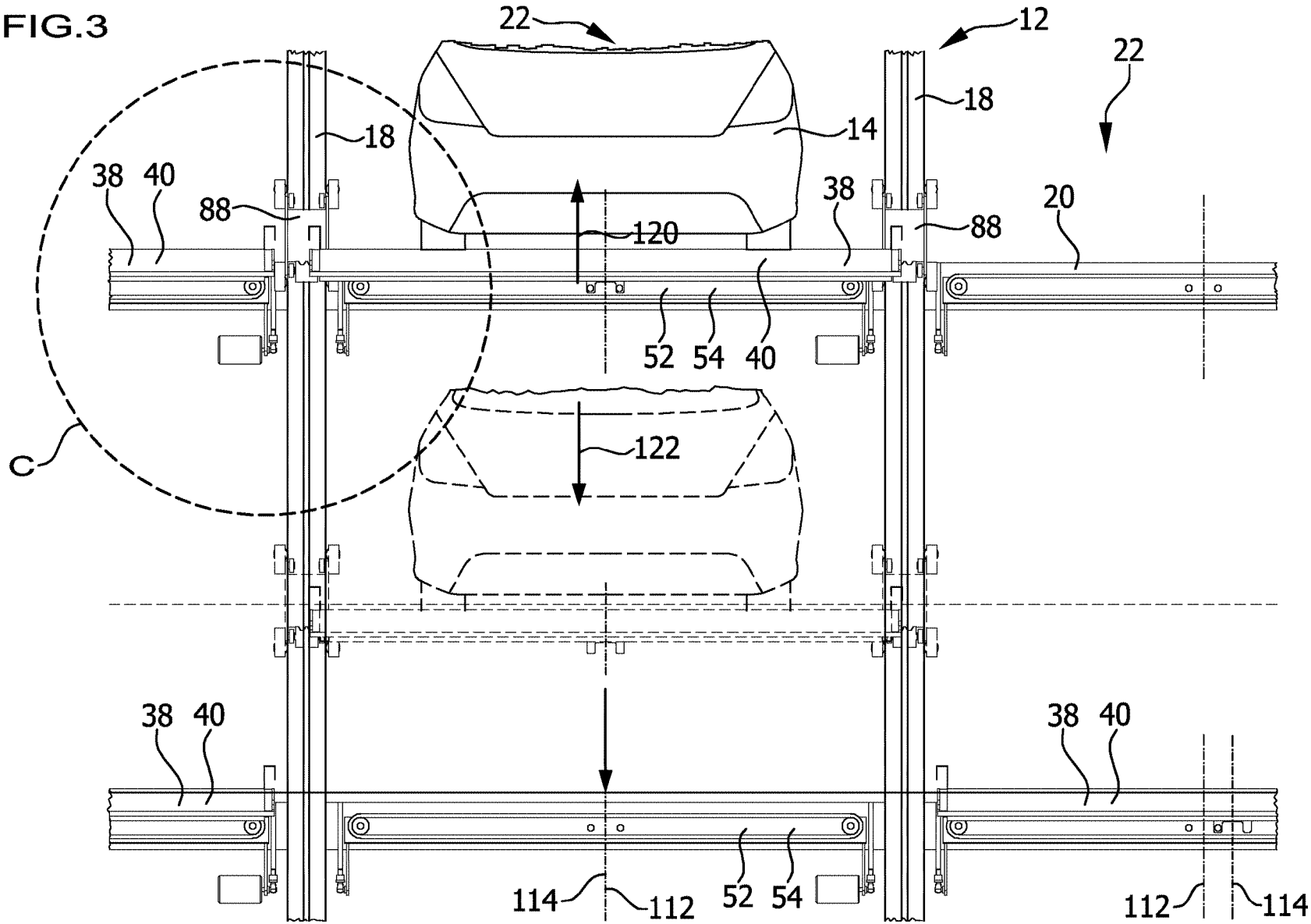
FIG. 3 illustrates an enlarged representation of detail A of FIG. 2, with a vehicle shown in the process of being retrieved.

The lifting elements 88 are displaced from below against the holding elements 48, and the pallet 40 is hooked onto the four lifting elements 88 (FIG. 3). The pallet 40 is raised somewhat by way of the lifting elements 88. Advantageously, the pallet 40 is raised no more than required to pivot the displacement device 54 from the supporting position to the release position.

The raising of the pallet 40 is indicated by an arrow 120.

Once the displacement device 54 assumes the release position, the vertical transport direction can be reversed and the pallet 40 lowered (arrow 122) until it reaches the level of the entrance 34 where it can be placed on the displacement devices 54 there.

In order to reduce the displacement movements in subsequent transactions, it is advantageous for one of the resulting empty spaces 50 in the uppermost intermediate level 32 to be re-loaded with a pallet 40.

Retrieving a vehicle 14 from one of the lower parking levels 26 can be realized in a corresponding manner. Here, possible pallets 40 above the vehicle 14 have to be removed from the parking grid 22 by transverse displacement thereof.

The pallets 40 assume a pass position at least in those parking levels 26 in which the lifting elements 88 are to be moved. The lifting elements are moved under the holding elements 48, and the corresponding pallet 40 with the vehicle 14 is moved to the transport position. Displacement devices 54 positioned thereabove are moved to the release position, and the pallet 40 with the vehicle 14 can be raised.

It is understood that the displacement devices 54 can be returned by default to a supporting position.

Figure 13:
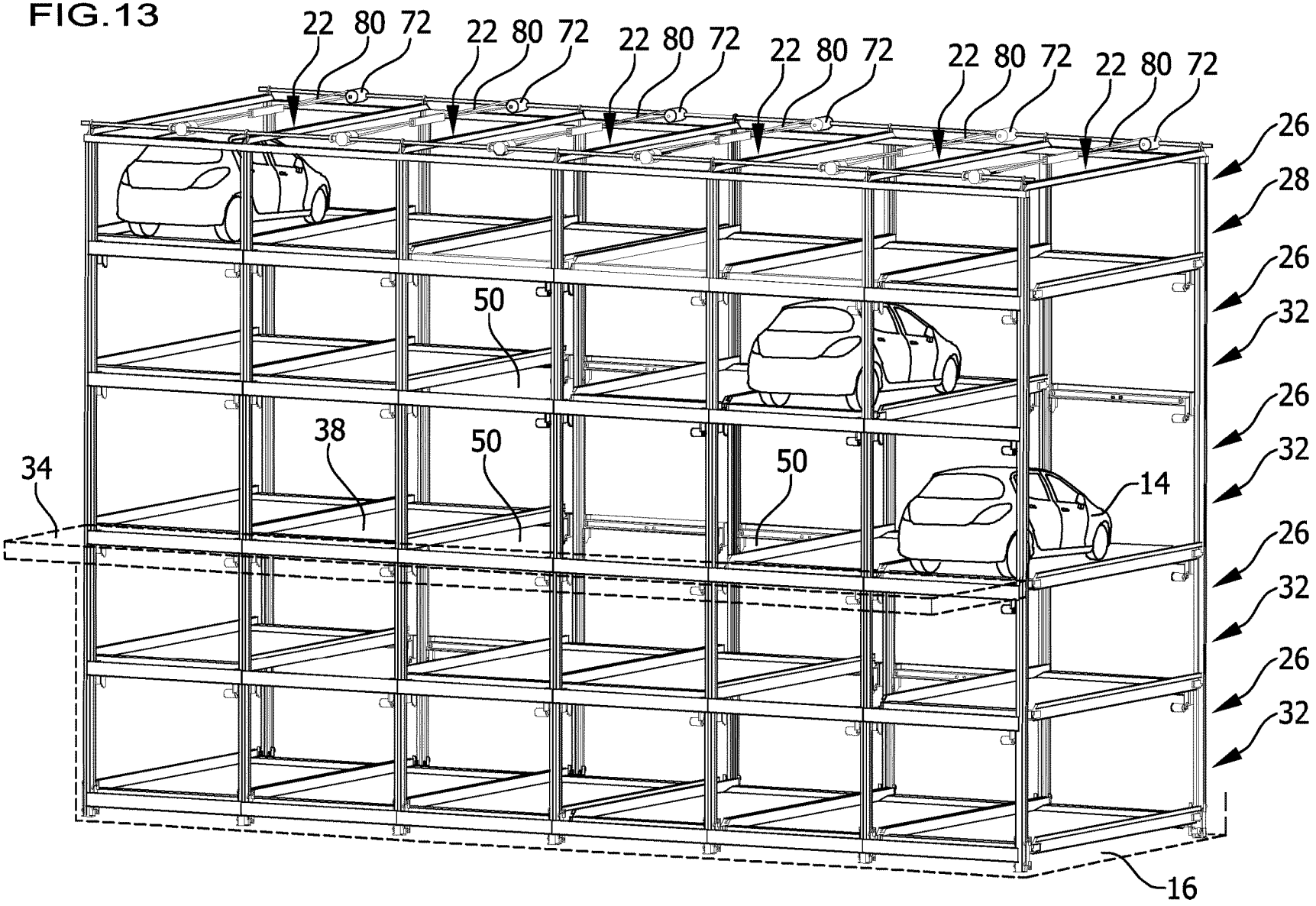
FIG. 13 illustrates a perspective schematic view of a further preferred embodiment of the parking facility in accordance with the disclosure.
Figure 14:
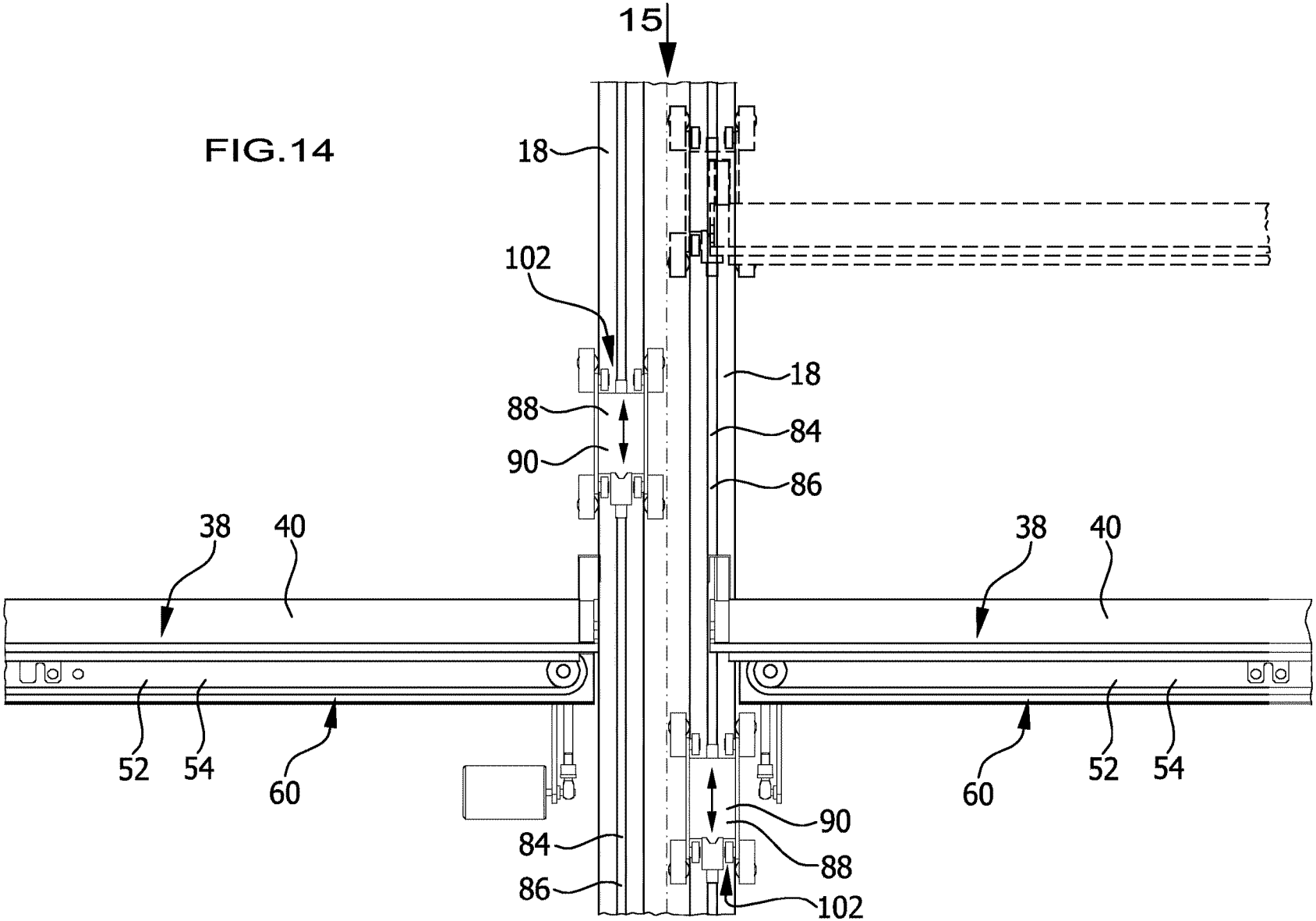
FIG. 14 illustrates an enlarged view of a detail of the parking facility of FIG. 13, showing displaceable lifting elements and receiving devices.
Figure 15:
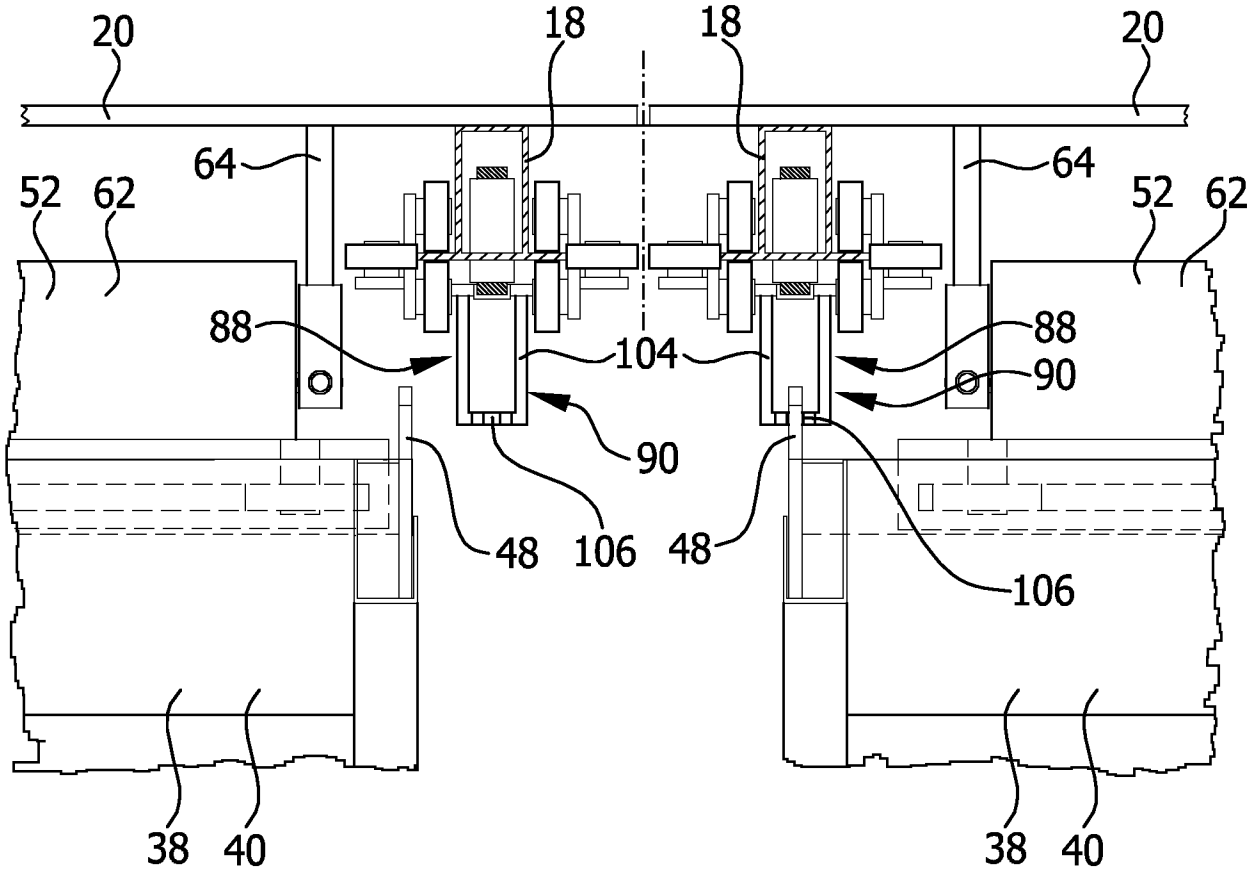
FIG. 15 illustrates a view in the direction of view shown by arrow "15" in FIG. 14.

Shown in FIGS. 13 to 15 is an advantageous embodiment of the parking facility in accordance with the disclosure, designated therein by reference numeral 130. In the parking facility 130, the same reference numerals are used for features and components that are identical to or functionally equivalent to those of the parking facility 10. The advantages that can be achieved with the parking facility 10 can also be achieved with the parking facility 130. Reference may be had to what has been described in the foregoing. Only the essential differences will be discussed.

In the parking facility 130, an independent lifting device 72 having its own drive unit 74 is provided at each parking grid 22. Also provided here are drive shafts 76, 78 and a synchronizing device 80, for example.

In the parking facility 130, four independent lifting elements 88 are associated with each parking grid 22; they serve to vertically transport pallets 40 only in the particular parking grid 22.

This is shown, by way of example, in FIGS. 14 and 15, wherein in this case the lifting elements 88 are arranged at separate vertical members 18. Provision could be made for both lifting elements 88 to be arranged for co-movement on a transverse member 20.

In this case, in lieu of the two support elements 106, only one support element 106 is provided since in any case only one pallet 40 of the same parking grid 22 is to be transported by a respective lifting element 88.

FIG. 15 shows the pallet 40 on the left in the drawing as being in the transport position, whereas the pallet 40 on the right in the drawing assumes a pass position.

In the parking facility 130, the advantage exists that vertical transport operations can be carried out independently of one another in different parking grids 22.

As has already been mentioned, in the parking facilities 10, 130, support devices 52 can be arranged at the front and rear of the parking rack 12, which support devices 52 in both cases are formed by a respective active displacement device 54, or vice versa. This is shown illustratively in FIGS. 9 to 11 using the example of the parking facility 10.

Figure 11:
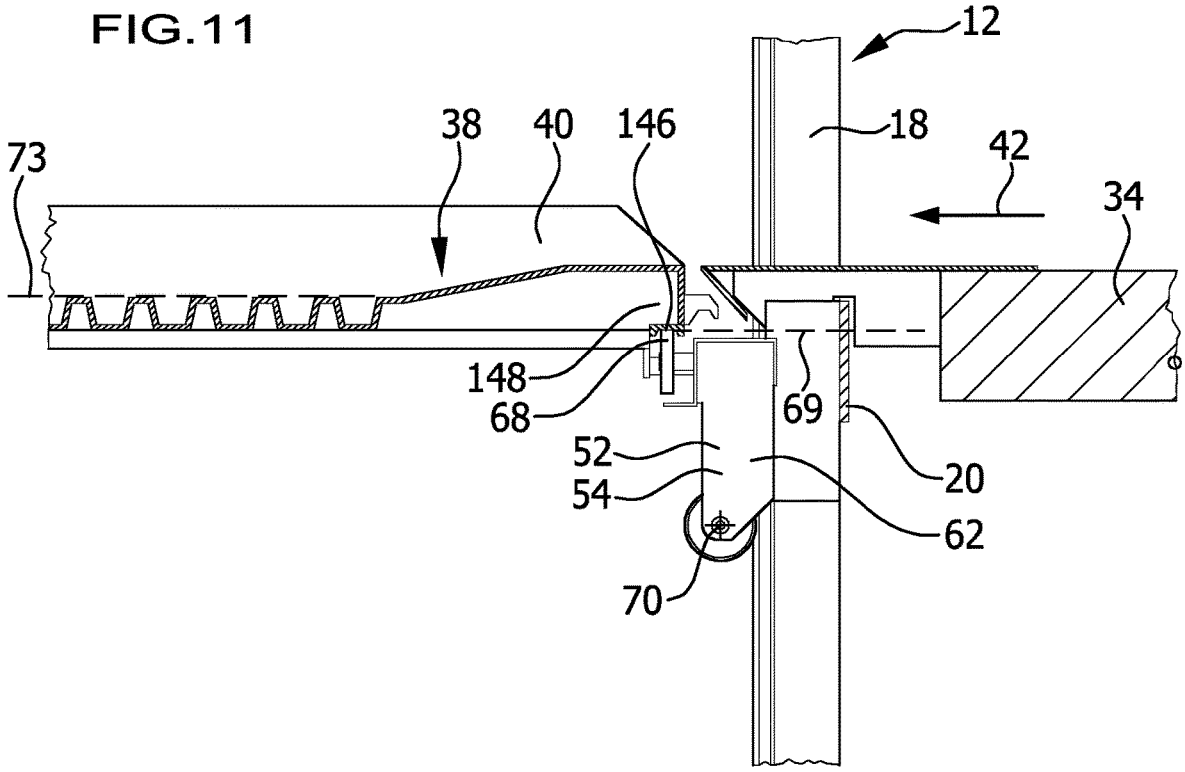
FIG. 11 illustrates an enlarged partial representation of the parking facility of FIG. 1, showing a connection to an entrance.

The pallet 40 is supported on the chain 68 at a respective support element 146 at a respective front and rear end section 148 thereof (FIG. 11). The chain 68 and the support element 146 form corresponding guide elements of a guide device for the pallet 40 when the latter is displaced within the parking grid 22 and/or into an adjacent parking grid 22.

As has also been mentioned above, provision can be made for a displacement device 54 to form a support device 52. In particular, both support devices 52 can be transferrable from the supporting position to the release position, and vice versa.

Figure 17:
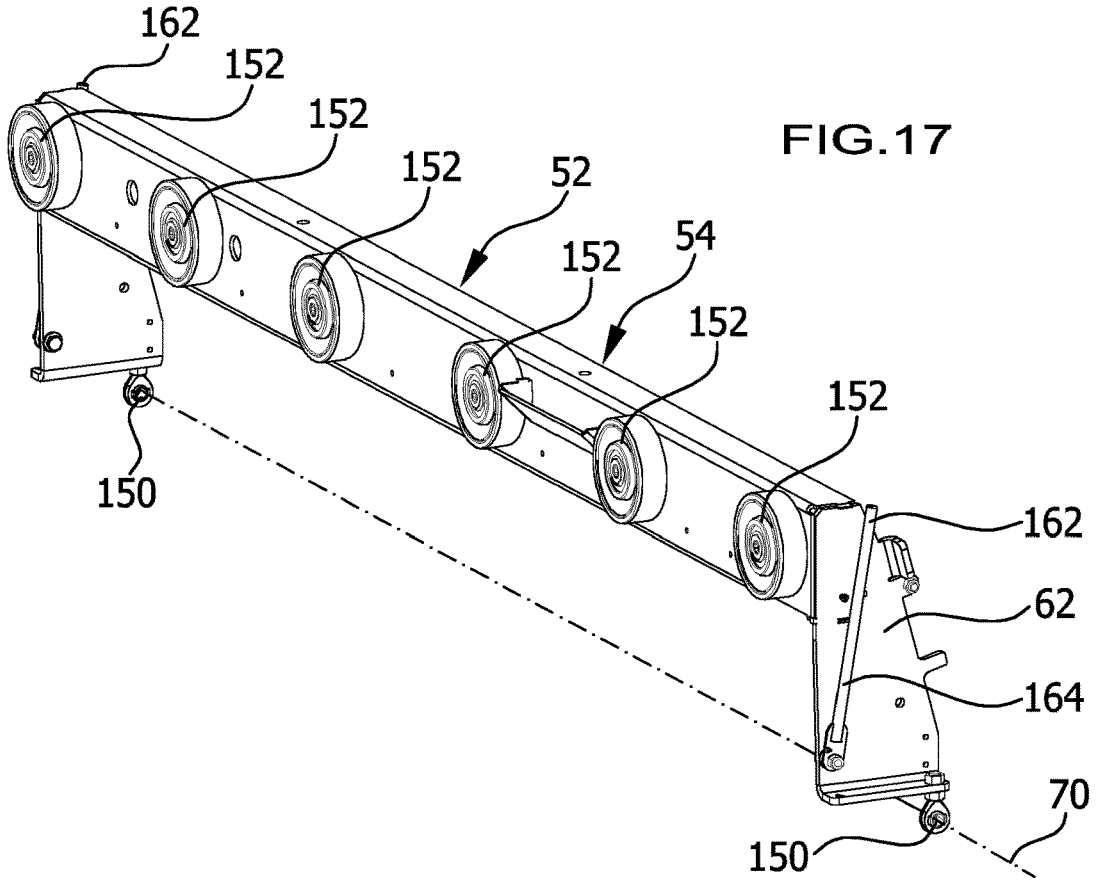
FIG. 17 illustrates a perspective representation of a support device of the parking facility in accordance with the disclosure.
Figure 19:
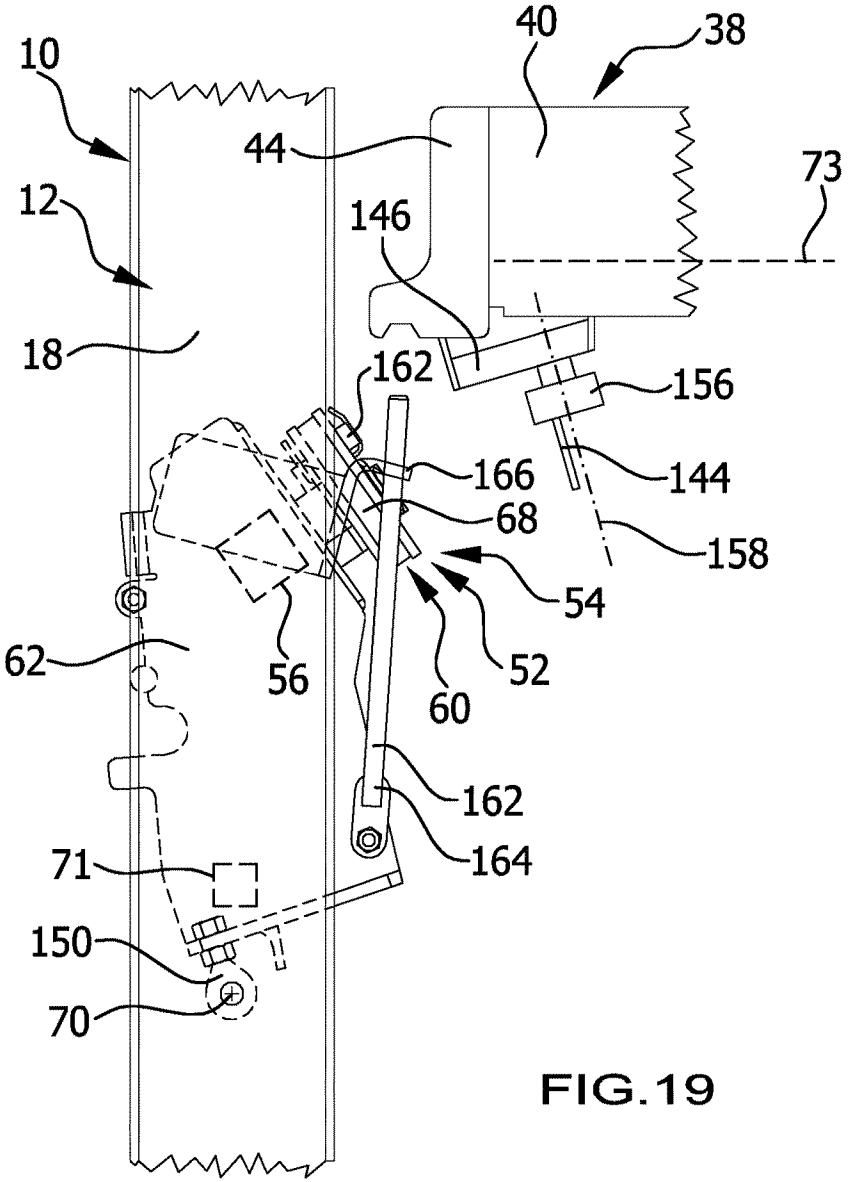
FIG. 19 illustrates a representation in accordance with FIG. 18, showing conditions after the parking platform has been raised and the displacement device has been transferred from the supporting position of FIG. 18 to a release position.
Figure 18:
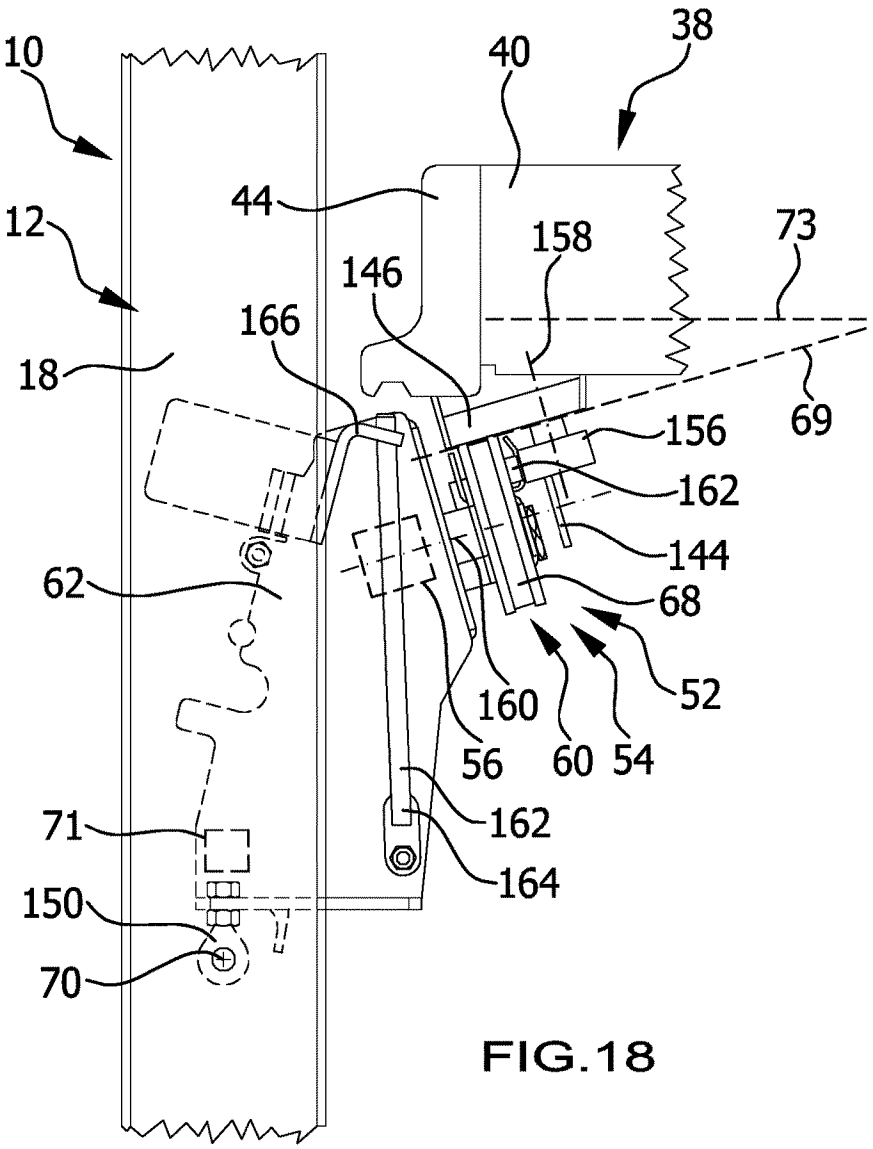
FIG. 18 illustrates, in a side view, a partial representation of the parking facility in accordance with the disclosure, showing the displacement device of FIG. 16 and a parking platform supported thereon.

FIGS. 17 to 19 show support devices 52 which can be used in lieu of the support devices 52 previously discussed for the case of the parking facility 10 or 130. Only the most significant differences compared with the configuration explained above are discussed. As for the rest, reference may be had to what has been described above.

Both support devices 52 are formed by displacement devices.

Figure 16:
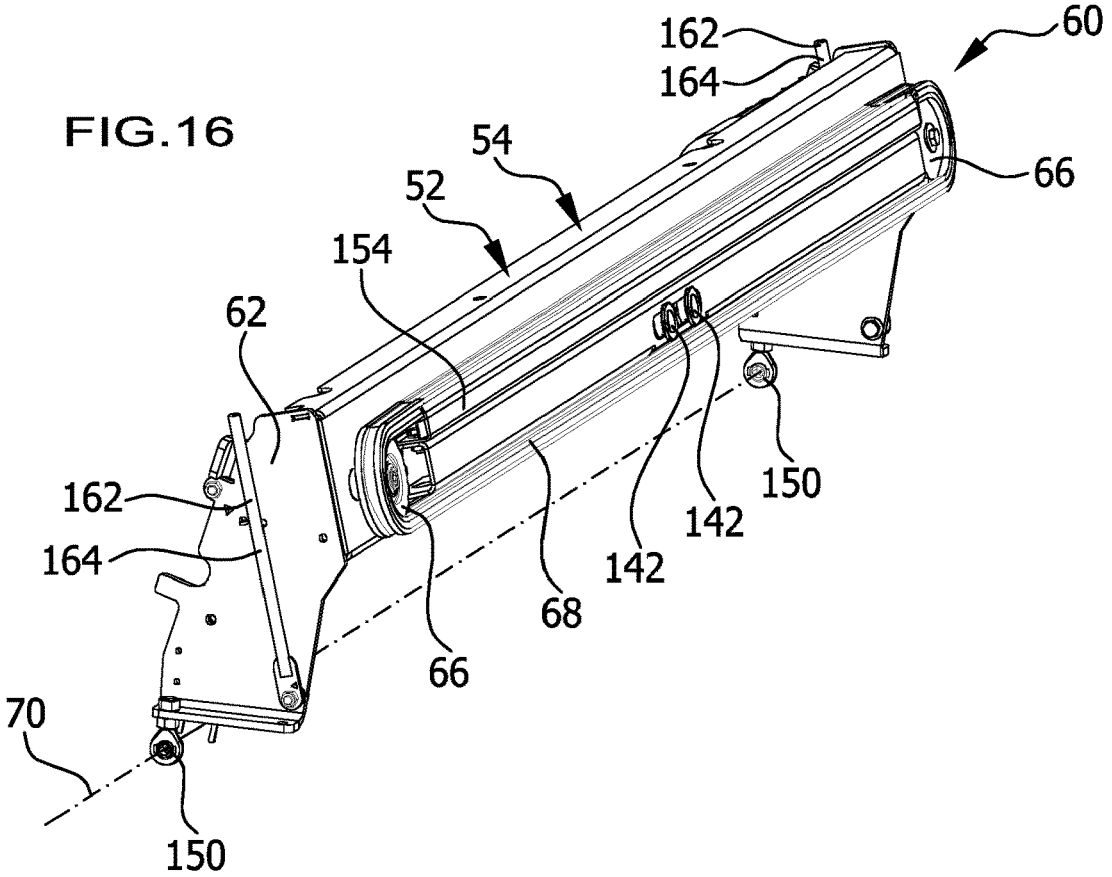
FIG. 16 illustrates a perspective representation of a displacement device of the parking facility in accordance with the disclosure, which displacement device forms a support device at the same time.

Here, it is preferably provided for an active displacement device 54 to be arranged at the front of the parking rack 12 and a passive displacement device 54 at the rear, i.e., at the entry side into the parking rack 12. Because generally the parking rack has a greater accumulation of dirt in the area of the entry side than at the front thereof, this then provides a way of keeping to a minimum the ingress of dirt to the active displacement device 54 at the front of the parking rack. Accordingly, the displacement device 54 of FIGS. 16, 18 and 19 is preferably arranged at the front of the parking rack and the passive displacement device 54 or support device 52 of FIG. 17 is arranged at the entry side.

Both support devices 52 each comprise the support 62, wherein the supports can be of substantially identical construction. A respective support 62 is supported on the parking rack 12 by way of bearing elements 150 for pivotal movement about the pivot axis 70, in the present case on the vertical members 18. The pivotal movement is imparted by the drive unit 71.

In the present case, the rear, passive support device 52 of FIG. 17 comprises a plurality of rollers 152. The rollers 152 are supported on the support 62 for rotation laterally next to one another along the longitudinal extension of the support 62 between transverse members 20 adjacent to one another. For example, the rollers 152 can be arranged equidistantly from one another on the support 62.

The pallet 40 can be supported at a rear end section 148 thereof on the rollers 152 (not shown). Here, for example, the contact plane 69 of the rollers 152 can be oriented parallel to the support plane 73 of the pallet 40.

The front, active displacement device 54 is also configured as a chain conveyor 60 with sprockets 66 and chain 68. The drive unit 56 can be controlled by the control device 58.

As can be seen from FIGS. 18 and 19 in particular, the support element 146 is arranged at the pallet 40 at a front end section 148 thereof. The support element 146 is configured in inclined relation to the support plane 73 and extends in a transverse direction of the pallet 40.

The contact plane 69 between the chain 68 and the support element 146 is configured in inclined relation to the support plane 73 and to the horizontal. Here, the contact plane 69 increases starting from the front side of the parking rack 12 towards the rear when the displacement device 54 assumes the supporting position (FIG. 18). Axes of rotation 160 of the sprockets 66 are oriented at an incline relative to the support plane 73 and at an incline relative to the horizontal when the displacement device 54 assumes the supporting position. Here, the axes of rotation 160 increase starting from the front side of the parking rack 12 towards the rear (FIG. 18).

In this way, when the pallet 40 is supported on the chain 68 via the support element 146, a centering thereof can be realized in a longitudinal direction of the parking rack 12.

To give additional support to the pallet 40, guide elements are provided at the pallet 40 and at the displacement device 54, these forming a guide device for guiding the pallet 40 when it is displaced within the parking grid 22 and/or into the adjacent parking grid 22.

In the present case, the displacement device 54 comprises as a guide element a guide track 154 which is configured as a strip along the extension of the support 62.

At the pallet 40, guide rollers 156 are arranged as guide elements. In the present case, a plurality of guide rollers 156 are provided, for example four of these. The guide rollers 156 are preferably arranged equidistantly from one another in the transverse direction of the pallet 40. Preferably, when the pallet 40 is displaced into an adjacent parking grid 22, a guide roller can cooperate with the guide track 154 of the displacement device 54 of the adjacent parking grid 22.

Axes of rotation 158 of the guide rollers 156 are preferably oriented transversely and in particular perpendicularly to the plane of the support element 146, and hence, when supported on the chain 68, transversely and in particular perpendicularly to the contact plane 69 (FIG. 18). When the pallet 40 is placed onto the chain 68, the centering thereof by the inclined orientation of the contact plane 69 causes the guide rollers 156 to come into contact against the guide track 154 and assume their target position.

FIG. 19 represents the assumption by the displacement device 54 of the release position. To this end, the pallet 40 is raised by way of the lifting elements 88, not shown in FIGS. 18 and 19, as has been described above. In the release position, the pallet 40 can be moved upwards and downwards past the displacement device 54 and, in a corresponding manner, past the passive support device 52 at the entry side, according to FIG. 17, assuming the release position.

Arranged at the support devices 52 of FIGS. 16 to 19 are in each case blocking elements 162 which face towards the respective adjacent parking grid 22. The support devices 52 arranged in the end grids 24 comprise a blocking element 162 facing at least towards the adjacent parking grid 22.

In the present example, the blocking element 162 is mechanically coupled to the support 62 and is configured as a bar 164 forming a stop. A stop element 166 for the bar 164 is arranged at the parking rack 12 (FIGS. 18 and 19). The bar 164 is pivotable relative to the support 62.

When the support device 52 is pivoted from the supporting position to the release position, the bar 164 pivots relative to the support 62 under the action of the stop element 166. In this way, the bar 164 is transferred to a blocking position (FIG. 19).

The bar 164 in the blocking position prevents the pallet 40 from being shifted into the parking grid by acting as a stop for the pallet 40.

When the support device 52 is transferred to the supporting position, the bar 164 is again pivoted relative to the support 62 under the action of the stop element 166 and brought to a non-blocking position. In the non-blocking position, the cross-section for displacement of the pallet 40 is released such that the pallet 40 can be displaced into the adjacent parking grid.

Overall, in the parking facility in accordance with the disclosure, it is advantageous for a blocking element to be provided, preferably at the support device, with which blocking element a shifting of the receiving device into the parking grid can be blocked.

| List of Reference Characters | |
|---|---|
| 10 | parking facility |
| 12 | parking rack |
| 14 | motor vehicle |
| 16 | supporting surface |
| 18 | vertical member |
| 20 | transverse member |
| 22 | parking grid |
| 24 | end grid |
| 26 | parking level |
| 28 | uppermost parking level |
| 30 | lowermost parking level |
| 32 | intermediate level |
| 34 | entrance |
| 36 | parking space |
| 38 | receiving device |
| 40 | parking platform/pallet |
| 42 | direction of entry |
| 44 | front side |
| 46 | rear side |

-continued

| List of Reference Characters | |
|---|---|
| 48 | holding element |
| 50 | empty space |
| 52 | support device |
| 54 | displacement device |
| 56 | drive unit |
| 58 | control device |
| 60 | chain conveyor |
| 62 | support |
| 64 | holding element |
| 66 | sprocket |
| 68 | chain |
| 69 | contact plane |
| 70 | pivot axis |
| 71 | drive unit |
| 72 | lifting device |
| 73 | support plane |
| 74 | drive unit |
| 76 | drive shaft |
| 78 | drive shaft |
| 80 | synchronizing device |
| 82 | chain |
| 84 | traction element |
| 86 | chain |
| 88 | lifting element |
| 90 | slider |
| 92 | base plate |
| 94 | plate |
| 96 | guide roller |
| 98 | guide roller |
| 100 | projection |
| 102 | guide device |
| 104 | receiving device |
| 106 | support element |
| 108 | centering region |
| 110 | projection |
| 112 | axis |
| 114 | axis |
| 116, 118, 120, 122 | arrow |
| 130 | parking facility |
| 140 | sensor device |
| 142 | sensor element |
| 144 | projection |
| 146 | support element |
| 148 | end section |
| 150 | bearing element |
| 152 | roller |
| 154 | guide track |
| 156 | guide roller |
| 158 | axis of rotation |
| 160 | axis of rotation |
| 162 | blocking element |
| 164 | bar |
| 166 | stop element |

The invention claimed is:

1. A parking facility for motor vehicles, the parking facility comprising:

a parking rack having two or more parking grids arranged adjacent to one another and side by side, the parking rack also comprising a plurality of parking levels arranged with one above another, the parking levels comprising an uppermost parking level, a lowermost parking level and at least one intermediate level interposed therebetween, at least one parking level being connected or connectable to an entrance, wherein the parking rack defines parking spaces for the motor vehicles at intersections of the parking grids with the parking levels, the parking rack having at least one empty space in the at least one intermediate level;

receiving devices for the motor vehicles, the receiving devices being positionable in the parking spaces;

at least one respective displacement device operative at a respective parking space for displacing the receiving devices in a respective parking level;

at least one lifting device having lifting elements, at least one lifting element being arranged at each parking grid, the lifting element being selectively coupleable to one of the receiving devices for vertical transport thereof within the respective parking grid; and a control device for controlling the at least one displacement device and the at least one lifting device;

wherein:

the receiving devices in at least the at least one intermediate level are configured to assume, by control of the at least one displacement device by the control device, in the respective parking grid, a transport position in which the receiving devices couple to the at least one lifting element at the respective parking grid for vertical transport in the respective parking grid, and the receiving devices in at least the at least one intermediate level are configured to assume at least one pass position in which, by way of the at least one displacement device, the receiving devices are, relative to the transport position, displaced laterally within the respective parking grid such that the at least one lifting element is vertically movable in the respective parking grid by way of the at least one lifting device, thereby passing past the respective receiving device, wherein the parking facility comprises at least one displacement device at a respective parking space for displacing a receiving device arranged at that parking space, and wherein:

an active displacement device with a drive unit is provided in each case at a front and a rear of the parking rack for displacing the receiving device; and/or an active displacement device with a drive unit is provided at only a front or only a rear of the parking rack for displacing the receiving devices.

2. A parking facility for motor vehicles, the parking facility comprising:

a parking rack having two or more parking grids arranged side by side and a plurality of parking levels arranged one above another, the parking levels comprising an uppermost parking level, a lowermost parking level and at least one intermediate level interposed therebetween, at least one parking level being connected or connectable to an entrance, wherein the parking rack defines parking spaces for the motor vehicles at intersections of the parking grids with the parking levels, the parking rack having at least one empty space in the at least one intermediate level;

receiving devices for the motor vehicles, the receiving devices being positionable in the parking spaces;

at least one displacement device operative at a respective parking space for displacing the receiving devices in a respective parking level;

at least one lifting device having lifting elements, at least one lifting element being arranged at each parking grid, the lifting element being selectively coupleable to one of the receiving devices for vertical transport of said one of the receiving devices within the respective parking grid; and a control device for controlling the at least one displacement device and the at least one lifting device, wherein:

the receiving devices in at least the at least one intermediate level are configured to assume, by control of the at least one displacement device by the control device, in the respective parking grid, a transport position in which the receiving devices couple to the at least one lifting element for vertical transport, the receiving devices in at least the at least one intermediate level are configured to assume at least one pass position in which, by way of the at least one displacement device, the receiving devices are, relative to the transport position, displaced laterally within the respective parking grid such that the at least one lifting element is vertically movable in the parking grid by way of the at least one lifting device, thereby passing past the respective receiving device, the parking facility comprises at least one displacement device at a respective parking space for displacing a receiving device arranged at that parking space, and wherein:

an active displacement device with a drive unit is provided in each case at a front and a rear of the parking rack for displacing the receiving device; and/or an active displacement device with a drive unit is provided at only a front or only a rear of the parking rack for displacing the receiving devices.

3. The parking facility in accordance with claim 2, wherein, by way of the at least one displacement device, receiving devices are displaceable into at least one parking grid adjacent to the respective parking grid.

4. The parking facility in accordance with claim 2, wherein the receiving devices in at least one of the uppermost level and the lowermost level are configured to assume the transport position and the at least one pass position.

5. The parking facility in accordance with claim 2, wherein at least one of the following applies:

the receiving devices in at least one pass position project in sections thereof into an adjacent parking grid; and the receiving devices in lateral end grids arranged at ends of the parking rack are configured to project laterally out of the end grid when in at least one pass position.

6. The parking facility in accordance with claim 2, wherein the receiving devices are configured to assume two different pass positions in which the receiving devices are displaced in two directions pointing away from each other, relative to the transport position.

7. The parking facility in accordance with claim 2, wherein the control device is configured to displace the receiving devices such that the receiving devices assume the at least one pass position in at least one base position when no storage or retrieval procedure for a vehicle is in progress.

8. The parking facility in accordance with claim 2, wherein the control device is configured to displace the receiving devices such that, absent an actuation of the at least one lifting device and the at least one displacement device, at least one parking grid in the at least one intermediate level is clear of a receiving device, the receiving devices of remaining parking grids being displaced in a respective pass position in a direction pointing away from the at least one parking grid.

9. The parking facility in accordance with claim 2, wherein the at least one lifting device comprises at least one traction element and a drive unit, which drive unit is coupled to the at least one lifting element via the at least one traction element, the at least one traction element being a chain, a toothed belt or a rope.

10. The parking facility in accordance with claim 2, wherein one of the following applies:

the parking facility comprises a lifting device which is associated with the lifting elements of all parking grids;

the parking facility comprises, associated with a respective parking grid, a lifting device; and the parking facility comprises two or more lifting devices, wherein at least one lifting device is associated with the lifting elements of two or more parking grids.

11. The parking facility in accordance with claim 10, wherein the lifting device which is associated with two or more parking grids comprises a drive unit and at least one drive element being a drive shaft which is coupled to the at least one lifting element of the respective parking grid.

12. The parking facility in accordance with claim 2, wherein two or more lifting elements are arranged at a respective parking grid for vertical transport of the receiving devices of that parking grid, and wherein at least one lifting element is provided in each case at a front and at a rear of the parking rack, relative to a longitudinal direction of the receiving devices.

13. The parking facility in accordance with claim 12, wherein the at least one lifting device comprises a synchronizing device which provides mechanical or electronical coupling of the at least one lifting element at the front to the at least one lifting element at the rear of the parking grid lifting elements, are in operative connection with one another.

14. The parking facility in accordance with claim 2, wherein four lifting elements are arranged at a respective parking grid for vertical transport of the receiving devices of that parking grid, wherein two lifting elements are arranged at a front of the parking rack and two lifting elements are arranged at a rear of the parking rack, for coupling in each case to mutually opposite sides of the receiving device.

15. The parking facility in accordance with claim 2, wherein one of the following applies:

the at least one lifting element of each parking grid, is coupleable only to the receiving devices of that parking grid; and at least one lifting element is arranged at adjacent parking grids in each case, for coupling to the receiving devices of the respective adjacent parking grids when the receiving devices assume the transport position, whereas the lifting element does not couple to the receiving devices when these assume a pass position.

16. The parking facility in accordance with claim 2, wherein the at least one lifting element comprises or forms at least one support element, and wherein the receiving devices each comprise or form a holding element for being supported on the at least one support element when the receiving devices assume the respective transport position.

17. The parking facility in accordance with claim 16, wherein at least one of the following applies:

the at least one support element forms a centering region for aligning the at least one holding element and the at least one support element relative to one another; and the receiving device is raisable by moving the lifting element from below against the holding element and raising the holding element by way of the at least one lifting element.

18. The parking facility in accordance with claim 2, wherein the at least one displacement device is configured as a chain conveyor, a belt conveyor or as a roller track.

19. The parking facility in accordance with claim 2, wherein at least one support device is provided for supporting the receiving devices when these are arranged at the parking space, the receiving device being supported on the at least one support device.

20. The parking facility in accordance with claim 19, wherein the at least one displacement device forms the at least one support device.

21. The parking facility in accordance with claim 19, wherein the at least one support device in at least the at least one intermediate level is transferrable from a supporting position in which the at least one support device supports the receiving device in the parking space, to a release position, and vice versa, in which release position the parking grid is released for vertical transport of the receiving devices by way of the at least one lifting device, past the support device.

22. The parking facility in accordance with claim 21, wherein the at least one support device in at least one of the uppermost parking level and lowermost parking level is also transferrable from a supporting position in which the at least one support device supports the receiving device in the parking space, to a release position, and vice versa, in which release position the parking grid is released for vertical transport of the receiving devices by way of the at least one lifting device, past the support device.

23. The parking facility in accordance with claim 2, wherein the receiving devices are configured as parking platforms.

24. The parking facility in accordance with claim 2, wherein the parking facility comprises a sensor device coupled to the control device for determining the position of the respective receiving device within a parking grid, the receiving device assuming at least one of the transport position and the at least one pass position.

25. The parking facility in accordance with claim 2, wherein the parking facility comprises an electrical charging device which comprises a charging unit at least one receiving device, to which charging unit the motor vehicle positioned on the receiving device is coupleable via an electrical connecting line or inductively.

26. The parking facility in accordance with claim 2, wherein the parking rack comprises, in addition to the parking grids arranged laterally side by side, at least one parking grid which is positioned in transverse relation to the arrangement of the parking grids arranged laterally side by side and in adjacent relation to one of these parking grids, and wherein between these parking grids a crossing by the vehicle is possible in at least one parking level.

27. A parking facility for motor vehicles, the parking facility comprising:

a parking rack having two or more parking grids arranged side by side and a plurality of parking levels arranged one above another, the parking levels comprising an uppermost parking level, a lowermost parking level and at least one intermediate level interposed therebetween, at least one parking level being connected or connectable to an entrance, wherein the parking rack defines parking spaces for the motor vehicles at intersections of the parking grids with the parking levels, the parking rack having at least one empty space in the at least one intermediate level;

receiving devices for the motor vehicles, the receiving devices being positionable in the parking spaces;

at least one displacement device operative at a respective parking space for displacing the receiving devices in a respective parking level;

at least one lifting device having lifting elements, at least one lifting element being arranged at each parking grid, the lifting element being selectively coupleable to one of the receiving devices for vertical transport of said one of the receiving devices within the respective parking grid; and a control device for controlling the at least one displacement device and the at least one lifting device, wherein:

the receiving devices in at least the at least one intermediate level are configured to assume, by control of the at least one displacement device by the control device, in the respective parking grid, a transport position in which the receiving devices couple to the at least one lifting element for vertical transport, the receiving devices in at least the at least one intermediate level are configured to assume at least one pass position in which, by way of the at least one displacement device, the receiving devices are, relative to the transport position, displaced laterally within the respective parking grid such that the at least one lifting element is vertically movable in the parking grid by way of the at least one lifting device, thereby passing past the respective receiving device, and the parking rack comprises, in addition to the parking grids arranged laterally side by side, at least one parking grid which is positioned in transverse relation to the arrangement of the parking grids arranged laterally side by side and in adjacent relation to one of these parking grids, and wherein between these parking grids a crossing by the vehicle is possible in at least one parking level.

* * * * *